US010460871B2

(12) United States Patent
Pinkerton et al.

(10) Patent No.: US 10,460,871 B2
(45) Date of Patent: Oct. 29, 2019

(54) METHOD FOR FABRICATING NON-PLANAR MAGNET

(71) Applicant: GM GLOBAL TECHNOLOGY OPERATIONS LLC, Detroit, MI (US)

(72) Inventors: Frederick E. Pinkerton, Shelby Township, MI (US); Anil K. Sachdev, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 430 days.

(21) Appl. No.: 15/290,660

(22) Filed: Oct. 11, 2016

(65) Prior Publication Data

US 2017/0125163 A1 May 4, 2017

Related U.S. Application Data

(60) Provisional application No. 62/248,865, filed on Oct. 30, 2015.

(51) Int. Cl.
*B21C 23/00* (2006.01)
*H01F 41/02* (2006.01)
(Continued)

(52) U.S. Cl.
CPC ..... *H01F 41/0266* (2013.01); *B21C 23/002* (2013.01); *B21C 23/06* (2013.01);
(Continued)

(58) Field of Classification Search
CPC ..... B21C 35/023; B21C 23/002; B21C 23/06; B21C 23/12; B21C 23/183; B21C 23/186
See application file for complete search history.

(56) References Cited

U.S. PATENT DOCUMENTS 4,648,915 A * 3/1987 Ibata ..... H01F 1/04 148/101
4,792,367 A 12/1988 Lee
(Continued)

FOREIGN PATENT DOCUMENTS

CN 87100530 A 9/1987
CN 101154490 A 4/2008
(Continued)

OTHER PUBLICATIONS

First Office Action for Chinese Patent Application No. 201610973502.1 dated Mar. 15, 2018 with correspondence from China Patent Agent (H.K.) Ltd. summarizing contents, 8 pages.

*Primary Examiner* — Debra M Sullivan
(74) *Attorney, Agent, or Firm* — Harness, Dickey & Pierce, P.L.C.

(57) ABSTRACT

A method for fabricating a non-planar magnet includes extruding a precursor material including neodymium iron boron crystalline grains into an original anisotropic neodymium iron boron permanent magnet having an original shape, wherein the original anisotropic neodymium iron boron permanent magnet has at least about 90 percent neodymium iron boron magnetic material by volume. The original anisotropic neodymium iron boron permanent magnet is heated to a deformation temperature. The original anisotropic neodymium iron boron permanent magnet is deformed into a reshaped anisotropic neodymium iron boron permanent magnet having a second shape substantially different from the original shape using heated tooling to apply a deformation load to the original anisotropic neodymium iron boron permanent magnet. The original anisotropic neodymium iron boron permanent magnet and the reshaped anisotropic neodymium iron boron permanent magnet each have respective magnetic moments substan-
(Continued)

tially aligned with a respective local surface normal corresponding to the respective magnetic moment.

15 Claims, 14 Drawing Sheets

(51) Int. Cl.

| | |
|---|---|
| ***B21D 22/02*** | (2006.01) |
| ***B21C 23/06*** | (2006.01) |
| ***B21C 23/12*** | (2006.01) |
| ***B21C 23/18*** | (2006.01) |
| ***B21C 35/02*** | (2006.01) |
| *B21D 35/00* | (2006.01) |

(52) U.S. Cl.
CPC ..... *B21C 23/12* (2013.01); *B21C 23/183* (2013.01); *B21C 35/023* (2013.01); *B21D 22/022* (2013.01); *B21D 22/025* (2013.01); *B21D 35/005* (2013.01)

(56) References Cited

U.S. PATENT DOCUMENTS

| | | | |
|---|---|---|---|
| 4,802,931 | A | 2/1989 | Croat |
| 4,844,754 | A | 7/1989 | Lee |
| 4,851,058 | A | 7/1989 | Croat |
| 4,881,985 | A | 11/1989 | Brewer et al. |
| 4,902,361 | A | 2/1990 | Lee et al. |
| 4,921,551 | A | 5/1990 | Vernia et al. |
| 6,684,483 | B2 | 2/2004 | Rahman et al. |
| 7,325,434 | B2 | 2/2008 | Esaki et al. |
| 7,730,755 | B2 | 6/2010 | Esaki et al. |
| 8,480,815 | B2 | 7/2013 | Wang |
| 9,142,350 | B2 | 9/2015 | Pinkerton |
| 9,272,332 | B2 | 3/2016 | Becker et al. |
| 9,468,972 | B2 | 10/2016 | Wang |
| 9,548,150 | B2 | 1/2017 | Zhou et al. |
| 10,062,482 | B2 | 8/2018 | Zhou et al. |
| 10,141,795 | B2 | 11/2018 | Thompson et al. |
| 10,186,374 | B2 | 1/2019 | Wang |
| 2009/0226339 | A1 | 9/2009 | Nakamura et al. |
| 2012/0285583 | A1 | 11/2012 | Meyer et al. |
| 2013/0026863 | A1 | 1/2013 | Asai |
| 2013/0160896 | A1 | 6/2013 | Skoug et al. |
| 2014/0191833 | A1 | 7/2014 | Sakuma et al. |

FOREIGN PATENT DOCUMENTS

| | | | |
|---|---|---|---|
| CN | 102859622 | A | 1/2013 |
| CN | 104043834 | A | 9/2014 |
| CN | 106653266 | A | 5/2017 |
| DE | 102016220654 | A1 | 5/2017 |
| EP | 0133758 | | 9/1990 |

* cited by examiner

METHOD FOR FABRICATING NON-PLANAR MAGNET

CROSS-REFERENCE TO RELATED APPLICATIONS

This application claims the benefit of U.S. Provisional Application Ser. No. 62/248,865, filed Oct. 30, 2015, which is incorporated by reference herein in its entirety.

TECHNICAL FIELD

The present disclosure relates generally to Rare Earth magnets, in particular to a method for fabricating non-planar anisotropic neodymium iron boron magnets.

BACKGROUND

An interior permanent magnet (IPM) machine is a brushless electric motor having permanent magnets embedded in its rotor core. Permanent magnet electric motors are reliable, light, and thermally efficient. In the past, however, permanent magnets have primarily been used on small, low-power electric motors, because of the relative difficulty associated with finding a material capable of retaining a high-strength magnetic field, and rare earth permanent magnet technology being in infancy.

Lower cost, high-intensity permanent magnets may be advantageous in an IPM machine. Compact, high-power permanent magnets may be useful in IPM machines for high-volume applications, such as for powering a vehicle, i.e. a hybrid or electric vehicle. IPM machines may be characterized by having favorable ratios of output torque versus the motor's physical size, as well as reduced input voltage. IPM machines may be reliable, in large part because permanent magnets are retained within dedicated slots of the machine's rotor. When supplied with motive energy from an external source, an IPM machine may also function as a generator. As a result, IPM machines may have a wide range of applications. For example, in the transportation industry, IPM machines may be used as powerplants for electric and hybrid electric vehicles. IPM machines may be used to move control surfaces, turn shafts and propellers, start engines, adjust seats and pedals, drive pumps, move machines, or any other application for motors or actuators.

SUMMARY

A method for fabricating a non-planar magnet includes extruding a precursor material including neodymium iron boron crystalline grains into an original anisotropic neodymium iron boron permanent magnet having an original shape, wherein the original anisotropic neodymium iron boron permanent magnet has at least 90 percent neodymium iron boron magnetic material by volume. The original anisotropic neodymium iron boron permanent magnet is heated to a deformation temperature. The original anisotropic neodymium iron boron permanent magnet is deformed into a reshaped anisotropic neodymium iron boron permanent magnet having a second shape substantially different from the original shape using heated tooling to apply a deformation load to the original anisotropic neodymium iron boron permanent magnet. The original anisotropic neodymium iron boron permanent magnet and the reshaped anisotropic neodymium iron boron permanent magnet each have respective magnetic moments substantially aligned with a respective local surface normal corresponding to the respective magnetic moment.

BRIEF DESCRIPTION OF THE DRAWINGS

Features of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
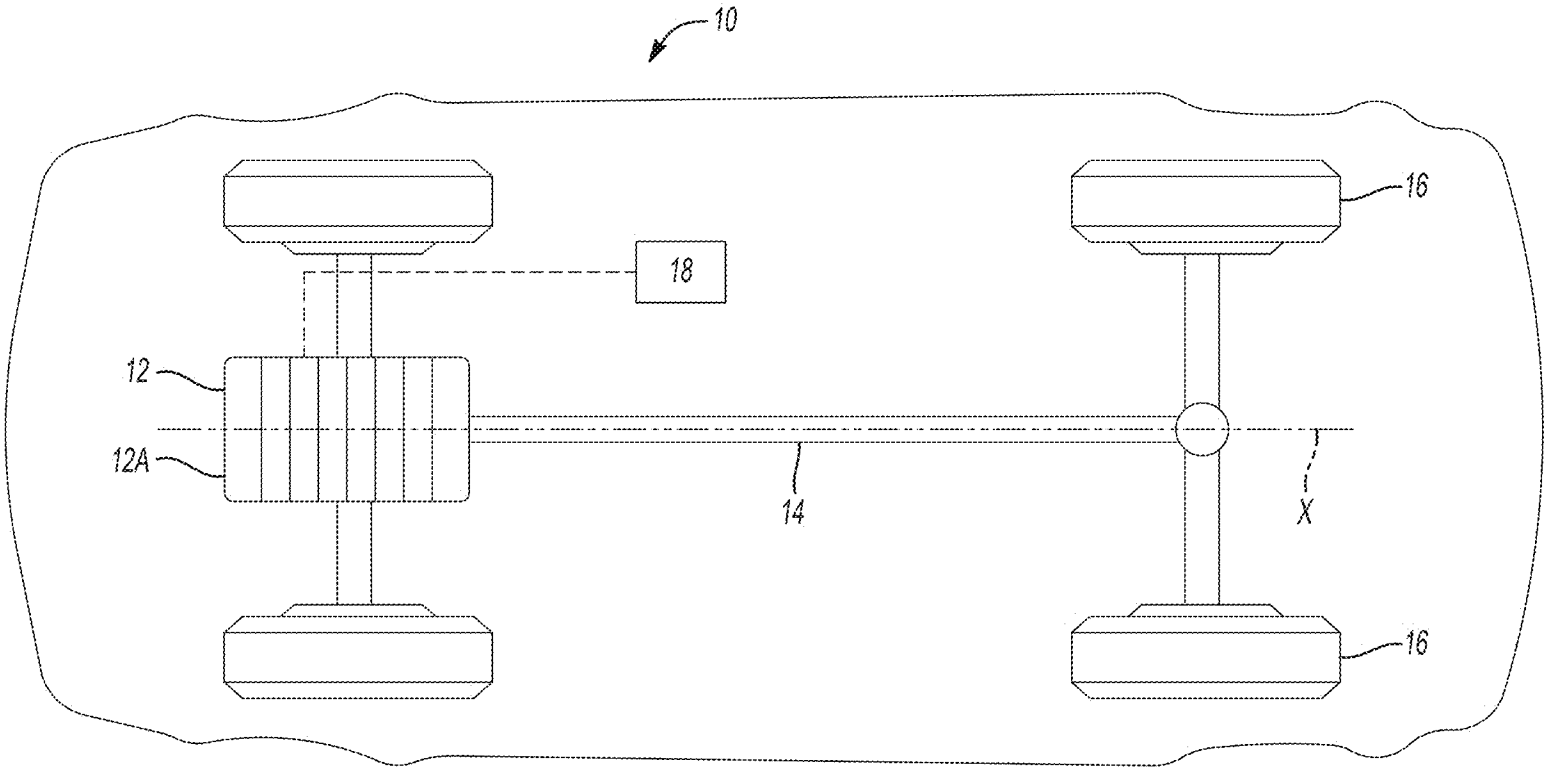
FIG. 1 is a schematic illustration of a vehicle including an interior permanent magnet machine.

FIG. 1 shows a vehicle 10 including an interior permanent magnet (IPM) motor or machine 12 to propel the vehicle 10. The IPM machine 12 can be to provide torque or force to another component of the vehicle 10, thereby propelling the vehicle 10. Aside from propelling the vehicle 10, the IPM machine 12 can be used to power other suitable apparatus. The IPM machine 12 may be a brushless motor and may include six substantially identical interconnected segments 12A disposed side by side along a rotational axis X, which is defined along the length of the IPM machine 12. It is contemplated, however, that the IPM machine 12 may include more or fewer segments 12A. The number of interconnected segments 12A is directly related to the torque the IPM machine 12 is capable of producing for propelling the vehicle 10.

The vehicle 10 may include a driveline 14 having a transmission and a driveshaft (not shown). The driveline 14 may be operatively connected between the IPM machine 12 and driven wheels 16 via one or more suitable couplers such as constant velocity and universal joints (not shown). The operative connection between IPM machine 12 and driveline 14 may allow the IPM machine 12 to supply torque to the driven wheels 16 in order to propel the vehicle 10.

In addition to the driveline 14, the vehicle 10 may include an energy-storage device 18 configured to supply electrical energy to the IPM machine 12 and other vehicle systems (not shown). Therefore, the energy-storage device 18 is electrically connected to the IPM machine 12. The IPM machine 12 may be configured to receive electrical energy from the energy-storage device 18 via the electrical connection and can operate as a generator when driven by a motive energy source of the vehicle 10 that is external to the IPM machine 12. Such external motive energy may be, for example, provided by an internal combustion engine (not shown) or by the driven wheels 16 via vehicle inertia or gravitational forces acting on the vehicle 10 to move the vehicle 10 downhill.

Figure 2:
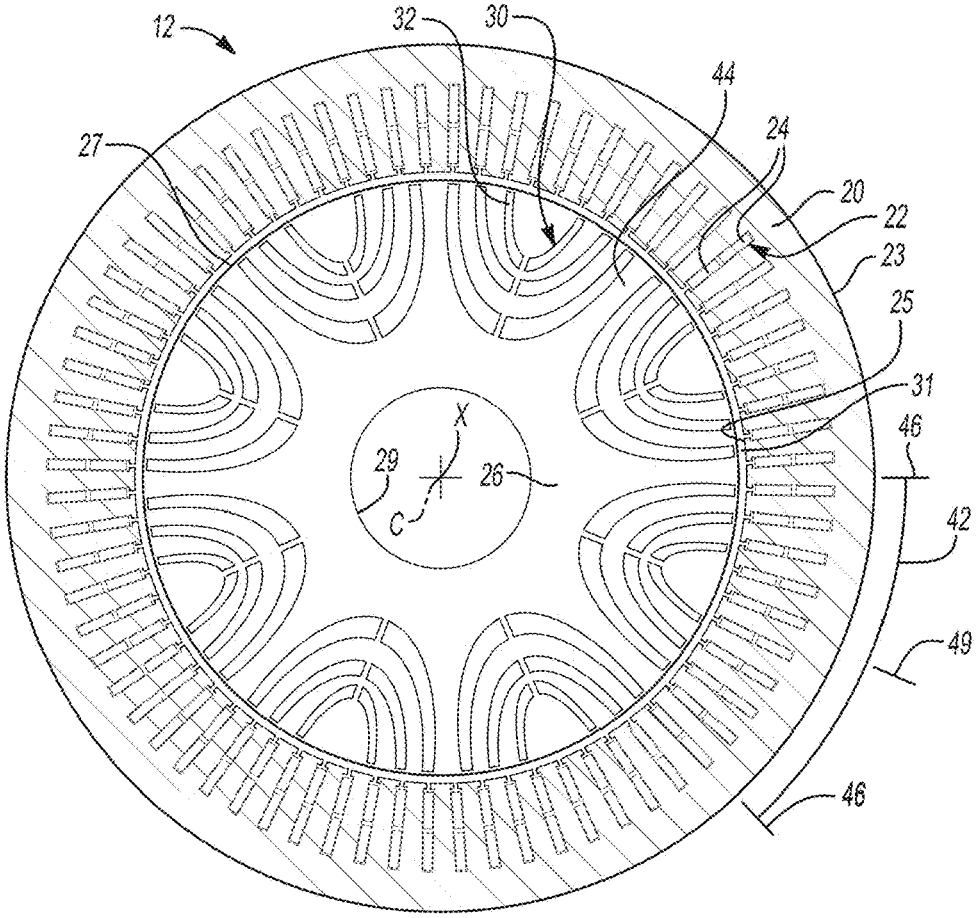
FIG. 2 is a front cross-sectional view of the interior permanent magnet machine schematically shown in FIG. 1.

FIG. 2 shows a cross-sectional view of a portion of IPM machine 12 schematically shown in FIG. 1. The IPM machine 12 may include a stator 20 having apertures 22 and electrical conductors 24 disposed in the apertures 22. The electrical conductors 24 may be electrically connected to the energy-storage device 18 (FIG. 1). This electrical connection may allow the energy-storage device 18 (FIG. 1) to supply electrical energy to the electrical conductors 24. The stator 20 may have a substantially annular shape and may be disposed around the rotational axis X. Furthermore, the stator 20 may define an outer stator surface 23 and an inner stator surface 25 opposite the outer stator surface 23. Both the outer stator surface 23 and the inner stator surface 25 may define a circumference around the rotational axis X. The apertures 22 may be disposed closer to the inner stator surface 25 than the outer stator surface 23 and each aperture may be shaped and sized to receive one or more electrical conductors 24. As used herein, the term "apertures" includes without limitation slits, slots, openings, or any cavity in the stator 20 configured and shaped to receive at least one electrical conductor 24. The electrical conductors 24 may be made of a suitable electrically conductive material such as metallic materials like copper and aluminum. The electrical conductors 24 can be configured as bars or windings and may have any suitable shape such as substantially rectangular, cuboid, and cylindrical shapes. Irrespective of its shape, each electrical conductor 24 is shaped and sized to be received in one aperture 22. Although the drawings show the apertures 22 containing two electrical conductors 24, each aperture 22 may contain more or fewer electrical conductors 24.

As depicted in FIG. 2, the IPM machine 12 may further include a rotor 26 disposed around the rotational axis X and within the stator 20. The stator 20 may be disposed concentrically with the rotor 26. The rotor 26 may be wholly or partly formed of a metallic material such as stainless steel, may have a substantially annular shape, and may define a plurality of rotor cavities 30 and a plurality of curved permanent magnets 32 disposed within the rotor cavities 30. The curved permanent magnets 32 may be tightly fitted in the rotor cavities 30 and may include an alloy of a rare earth element such as neodymium, samarium, or any other suitable ferromagnetic material. Suitable ferromagnetic materials include a Neodymium Iron Boron (NdFeB) alloy and a Samarium Cobalt (SmCo) alloy. The curved permanent magnets 32 may be arranged annularly around the rotational axis X and are configured to magnetically interact with the electrical conductors 24. During operation of the IPM machine 12, the rotor 26 revolves relative to the stator 20 around the rotational axis X in response to the magnetic flux developed between the electrical conductors 24 and the curved permanent magnets 32, thereby generating drive torque to power the vehicle 10.

As depicted in FIG. 2, the rotor 26 may define an outer rotor end 27 and an inner rotor end 29 opposite the outer rotor end 27. Both the outer rotor end 27 and the inner rotor end 29 may define a circumference around the rotational axis X. The IPM machine 12 may define an air gap 31 between the inner stator surface 25 and the outer rotor end 27. The air gap 31 may have a substantially annular shape and spans around the rotor 26. The rotor 26 may include a plurality of polar pieces 42 arranged annularly around a rotor center C, which may coincide with the rotational axis X. Although FIG. 2 depicts eight polar pieces 42, the rotor 26 may include more or fewer polar pieces 42. Inter-polar bridges 44 may separate consecutive polar pieces 42 and can be elongated along respective inter-polar axes 46. Each inter-polar axis 46 extends through the rotor center C and substantially through the middle of a respective inter-polar bridge 44 and defines the demarcation between two consecutive polar pieces 42. Consecutive polar pieces 42 have opposite polarities. Each polar piece 42 may further define a center pole axis 49 extending through the rotor center C and substantially through the middle of said polar piece 42. The center pole axis 49 of each polar piece 42 may also intersect the rotational axis X.

The present disclosure is applicable to NdFeB magnets. It is to be understood that neodymium iron boron magnets contain Neodymium, Iron and Boron but also encompass a wide variety of chemical compositions, added and/or substituted elements, or other modifications of the chemical or structural composition.

Existing magnets have been made by injection molding powdered melt-spun NdFeB ribbon flakes, however, in order to make the material compatible with the injection molding process, the NdFeB ribbon flakes are mixed with about 30 percent to about 50 percent (by volume) plastic filler/binding material. Thus the magnetic density of existing injection molded NdFeB magnets is low. Except when molded in a strong magnetic field, these injection molded NdFeB magnets are isotropic, which further reduces the magnetic strength of the injection molded product compared to magnets produced using the method of the present disclosure. In order to obtain anisotropic injection molded magnets, a magnetic field has been applied as part of the injection molding process to preferentially align the magnetic particles. The existing injection molding method often results in imperfect particle alignment with some individual particles misaligned by as much as 70° from the surface normal. Magnetization along the surface normal of the finished magnet can be 30-40% of the saturation magnetization of the neodymium iron boron magnet material.

Another existing method for creating shaped NdFeB magnets is to press powdered NdFeB into a block under an applied magnetic field and sinter the block so it holds its shape. Shapes other than rectangular slabs may be formed from the sintered block by grinding. The sintered NdFeB magnets may be fully dense, however, grinding material off of the large blocks to yield shapes other than rectangular slabs is expensive and wastes a large fraction of the sintered block. Also, sintered NdFeB can be magnetized only in one unique direction; if a sintered NdFeB magnet is cut into a curved shape the alignment at the ends of the curve will not be normal to the curve. Further, such fully dense sintered NdFeB magnets may be extremely brittle, causing a tendancy to fracture when the sintered NdFeB magnets are handled.

Hot extruded NdFeB magnets may offer an alternative to sintered magnets. Like sintered magnets, the existing hot extruded NdFeB magnets rely on the exceptional large magnetic moment and uniaxial anisotropy of the $Nd_2Fe_{14}B$ phase, in a microstructure that resists magnetic switching. The existing extruded magnets, however, achieve magnetic hardening by a different process compared to the method for sintered magnets. The existing extruded magnets are based on magnetically isotropic melt-spun NdFeB ribbons, where the extremely high cooling rates (>100000° C./s) form randomly oriented equiaxed grains of $Nd_2Fe_{14}B$ with grain sizes in the range 30-100 nm (nanometers)—two orders of magnitude smaller than the 3-10 μm (micrometers) grain diameters in sintered magnets. The ribbons are consolidated to full density by hot pressing at temperatures between about 500 and 800° C., followed by hot extrusion at about 800° C. During extrusion a remarkable combination of preferential grain growth and grain rotation during flow produces magnetic orientation perpendicular to the extrusion direction. Back extruded, radially oriented ring magnets are commercially available, and forward extruded rectangular plates with magnetic orientation perpendicular to the plate have been disclosed. The magnetic properties of extruded NdFeB rival those of sintered magnets, and exhibit good temperature performance even in compositions without heavy rare earths. However, the existing extruded NdFeB magnets are only available as ring magnets and flat plates. Even if the existing extruded NdFeB ring magnets are divided into segments, the resulting magnets are limited to circular arc segments. In sharp contrast, the magnets of the present disclosure may be in any shape including parabolic segments, elliptical segments or any general shape or size.

Figure 3:
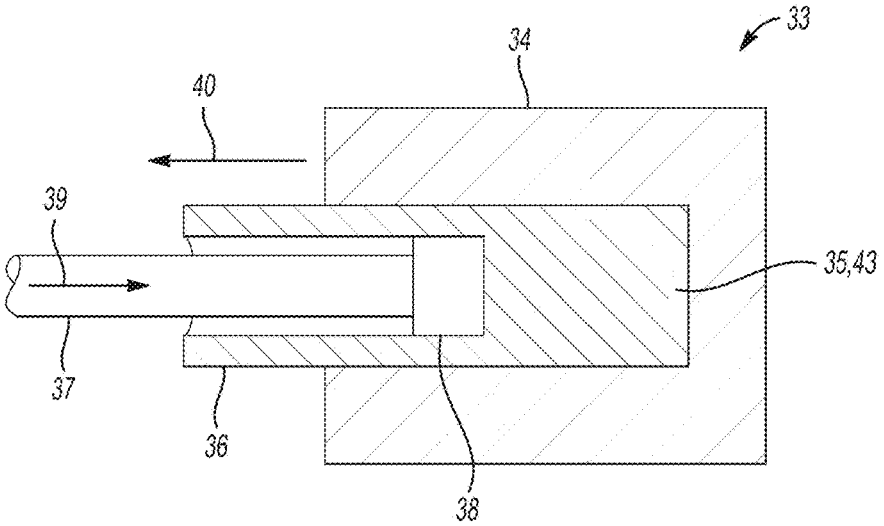
FIG. 3 is semi-schematic cross-sectional view of an apparatus for back-extrusion of an annular cylinder.

FIG. 3 is semi-schematic cross-sectional view of an apparatus 33 for back-extrusion of an annular cylinder 36. A work billet 35 is heated in a container 34. A ram 37 forces a die 38 into the work billet 35 causing the annular cylinder 36 to extrude in an opposite direction 40 to the direction of movement 39 of the die 38 between the die 38 and the container 34.

This present disclosure includes a method for forming a curved permanent magnet 32 from a magnet originally formed as a hot deformed plate or ring. Existing fabrication methods may be used to make Neodymium Iron Boron (NdFeB) plate and ring magnets by extrusion of powdered melt-spun NdFeB ribbon flakes. An example of an existing fabrication method is back-extrusion (See FIG. 3) of melt-spun precursor powder to form ring magnets. In examples of the present disclosure, the precursor powder has at least 90 percent NdFeB magnetic material by volume. The extrusion process causes the magnetic moments to be mechanically aligned by extrusion flow. Thus, hot extruded NdFeB plate and ring magnets are anisotropic.

Extrusion temperatures may range from about 600° C. to about 900° C. The present disclosure includes subsequent secondary hot deformation to convert plate magnets into a curved shape, or to form non-circular magnet segments by hot deforming a circular ring magnet. Without being held bound to any theory, it is believed that non-planar and anisotropic neodymium iron boron permanent magnets of the present disclosure may be advantageously used to make more energy efficient IPM machines compared to IPM machines that have magnets in the form of flat plates or circular segments. Ultimately, the improved method of the present disclosure will generate more energy efficient IPM machines at a lower cost. Thus the improved method of the present disclosure may be used to manufacture more energy efficient vehicles at a lower cost.

The present disclosure includes an example of a method for fabricating a non-planar magnet including the following steps: 1. Extruding a precursor material 43 (see, e.g. FIG. 3) including neodymium iron boron crystalline grains into an original anisotropic neodymium iron boron permanent magnet 45 having an original shape 47 (see, e.g. FIG. 7A). The original anisotropic neodymium iron boron permanent magnet 45 has at least 90 percent neodymium iron boron magnetic material by volume. 2. Heating the original anisotropic neodymium iron boron permanent magnet 45 to a deformation temperature. 3. Deforming the original anisotropic neodymium iron boron permanent magnet 45 into a reshaped anisotropic neodymium iron boron permanent magnet 50 having a second shape 51 substantially different from the original shape 47 using heated tooling to apply a deformation load to the original anisotropic neodymium iron boron permanent magnet 45. It is to be understood that the deforming step of the present disclosure does not include significant material removal. In other words, substantially all of the material in the original anisotropic neodymium iron boron permanent magnet 45 is deformed into the reshaped anisotropic neodymium iron boron permanent magnet 50. In an example, an insignificant amount of material may be removed from the original anisotropic neodymium iron boron permanent magnet 45 by wear against the die. As used herein, "substantially different from the original shape" means that the difference in shape from permanent deformation is more than manufacturing variation.

In another example, the method may include the following steps: A) heating a precursor material including neodymium iron boron crystalline grains to an extrusion temperature; B) extruding the precursor material into an original anisotropic neodymium iron boron permanent magnet having an original shape, wherein the original anisotropic neodymium iron boron permanent magnet has at least 90 percent neodymium iron boron magnetic material by volume; and C) deforming the original anisotropic neodymium iron boron permanent magnet into a reshaped anisotropic neodymium iron boron permanent magnet having a second shape substantially different from the original shape using tooling to apply a deformation load to the original anisotropic neodymium iron boron permanent magnet before the original anisotropic neodymium iron boron permanent magnet cools below a minimum deformation temperature. In the example described in this paragraph, the extrusion temperature may be from about 450° C. to about 900° C.; and the minimum deformation temperature may be from about 450° C. to about 900° C.

The original anisotropic neodymium iron boron permanent magnet may be deformed into the reshaped anisotropic neodymium iron boron permanent magnet having the second shape substantially different from the original shape using any suitable tooling to apply a deformation load to the original anisotropic neodymium iron boron permanent magnet. Non-limitative examples of suitable tooling include forging dies, reshaping dies and rollers. The tooling may move relative to the original and reshaped anisotropic neodymium iron boron permanent magnet. Alternatively, the original and reshaped anisotropic neodymium iron boron permanent magnet may move relative to the tooling. For example, an original shaped magnet having a rectangular prism shape may be deformed by impinging the original shaped magnet onto a sturdy curved surface to deflect the reshaped magnet into a curved shape. A reshaping die may be used to reshape the cross-sectional area of an originally extruded magnet without significantly changing the magnitude of the cross-sectional area thereby altering the shape and curvature of the magnet after the magnet has exited the extrusion die. As used herein, "significantly changing the magnitude of the cross-sectional area" means changing the total area in the cross-section by more than manufacturing variation. For example, if the magnitude of the cross-sectional area is 100 square millimeters, the magnitude of the cross-sectional area after the magnet has passed through the reshaping die would be between 95 square millimeters and 102 square millimeters. The magnitude of the cross-sectional area may be determined normal to a transport direction of the extruded precursor material during the step of extruding the precursor material. As used herein, a prism is a solid shape that has two opposite faces that are the same size and shape (congruent). All other faces, connecting these two opposite faces, are rectangles. In rectangular prisms, the two opposite faces are rectangles, so all six faces are rectangles. Most boxes are rectangular prisms. Rectangular prisms may also be called rectangular solids.

Figure 4A:
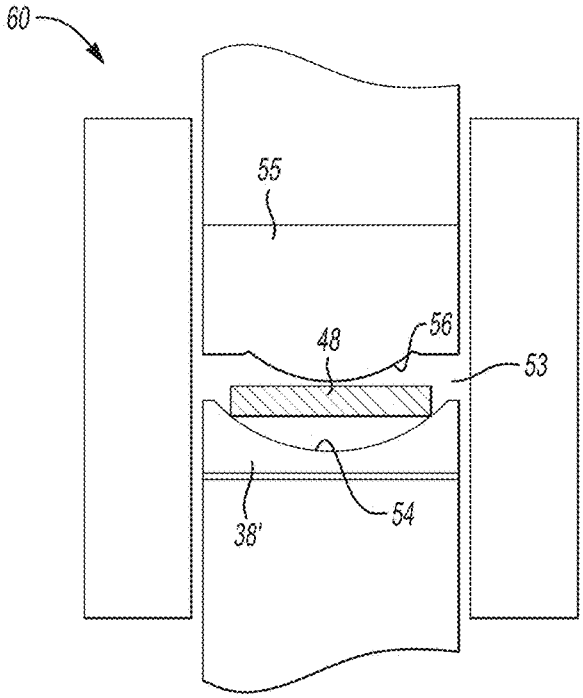
FIG. 4A is a semi-schematic cross-sectional side view of an example of a press for hot deformation of a plate magnet according to the present disclosure.
Figure 4B:
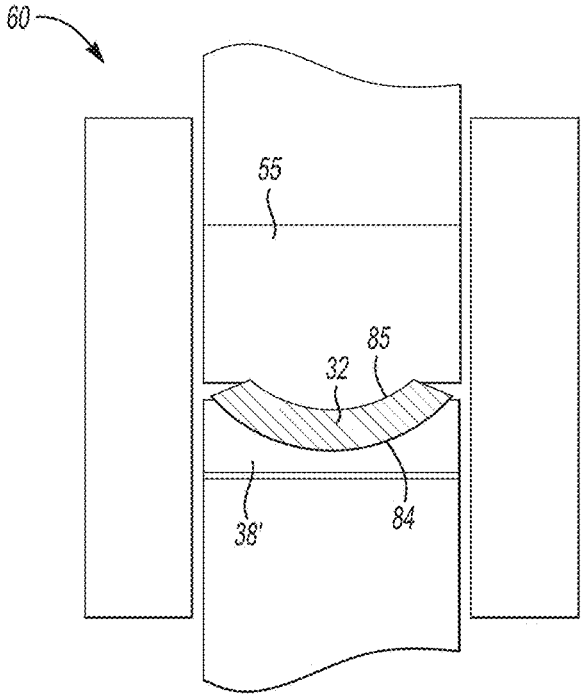
FIG. 4B is a semi-schematic cross-sectional side view of the example of the press depicted in FIG. 4A shown after the plate magnet has been hot deformed to a curved magnet according to the present disclosure.

FIG. 4A and FIG. 4B illustrate an example of the method of the present disclosure. In the example depicted in FIG. 4A and FIG. 4B, the original anisotropic neodymium iron boron permanent magnet is a hot extruded flat plate magnet 48. The primary deformation of the original anisotropic neodymium iron boron permanent magnet occurs in the extrusion process that creates the flat plate magnet 48. According to the present disclosure, a secondary hot deformation process renders a curved permanent magnet 32 from the flat plate magnet 48. The flat plate magnet 48 is placed into a die cavity 53 having a concave curved lower die surface 54, such that the flat plate magnet 48 is suspended along its edges above the concave curved lower die surface 54. The heated punch 55 and the heated die 38' together define the die cavity 53. The die cavity 53 defines at least an outer surface 84 of the second shape 51 that the flat plate magnet 48 will be transformed into. In the example depicted in FIG. 4B, the die cavity 53 also defines an inner surface 85 of the second shape 51. In an example, an outer surface contour 86 of the second shape 51 may define a segment of a parabolic cylinder 57. In another example, an outer surface contour 86 of the second shape 51 may define at least a portion of an elliptic cylinder 58. It is to be understood that positions of the heated die 38' and heated punch 55 may be exchanged.

Figure 18:
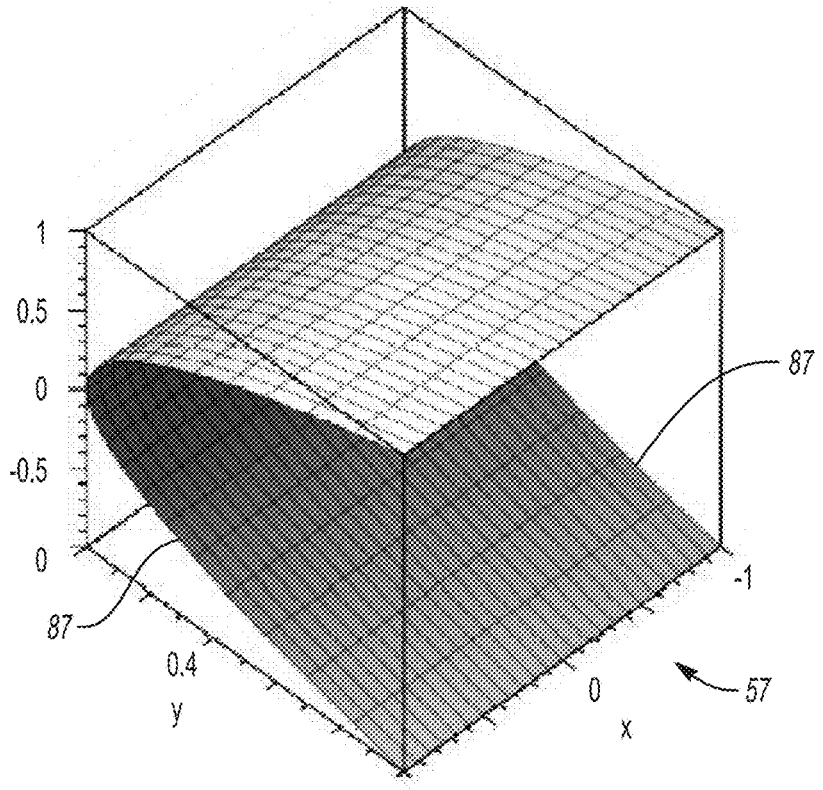
FIG. 18 is a graphical representation of a parabolic cylinder as disclosed herein.

As used herein, the term "cylinder" means a three-dimensional (3D) geometric figure having 2 congruent and parallel bases. The bases of the cylinder are not necessarily closed curves. An example of a parabolic cylinder 57 is depicted in FIG. 18. It is to be understood that shapes that would otherwise be cylindrical with variation including bases that are not parallel are contemplated herein. Further, minor variation to the described examples, for example, beveled ends of an annular cylinder are also included in the present disclosure.

The flat plate magnet 48, die 38', and punch 55 are then heated to the hot deformation temperature (600° C. to 900° C.) and pressure is applied between the die 38' and the punch 55 with a complementary convex curve 56 to deform the flat plate magnet 48 into the curved permanent magnet 32 having the second shape. At the end of the secondary hot deformation step, contact with the concave curved lower die surface 54 and the convex curve 56 of the punch 55 will heal any cracks or non-uniformities that might occur during the portions of the secondary deformation process in which portions of the flat plate magnet 48 are unsupported. In other words, cracks may form in the flat plate magnet 48 during the secondary deformation process; however heat and pressure will cause material flow to close the cracks.

Figure 5A:
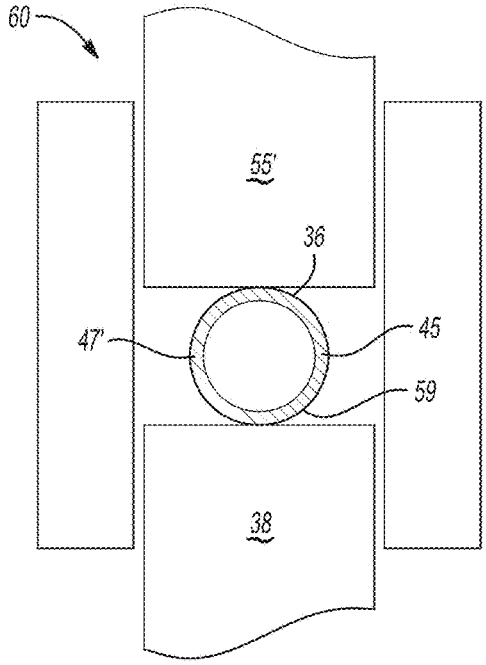
FIG. 5A is a semi-schematic cross-sectional side view of an example of a press for hot deformation of a circular ring magnet according to the present disclosure.
Figure 5B:
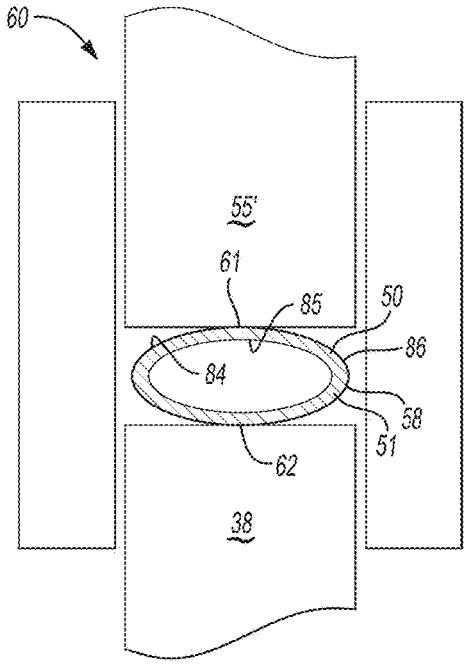
FIG. 5B is a semi-schematic cross-sectional side view of the example of the press depicted in FIG. 5A shown after the circular ring magnet has been hot deformed to a hollow tubular magnetic body with a wall surface defining an ellipse in cross-section according to the present disclosure.

FIG. 5A and FIG. 5B show another example of the method of the present disclosure. In the example depicted in FIGS. 5A and 5B, the original shape 47' of the original anisotropic neodymium iron boron permanent magnet 45 is an annular cylinder 36. The punch 55' and the die 38 depicted in FIGS. 5A and 5B are flat, and do not define a die cavity. The original anisotropic neodymium iron boron permanent magnet 45 may be a ring magnet 59 with a circular cross-section. As disclosed herein, the ring magnet 59 is placed between the punch 55' and a die 38 and heated to the deformation temperature. After reaching the deformation temperature, a press 60 applies a force at a punch contact point 61 and a die contact point 62 to deform the ring magnet 59 from the original (annular) shape 47 to the second (non-circular) shape 51. In the example depicted in FIGS. 5A and 5B, the outer surface contour 86 of second shape 51 defines an elliptic cylinder 58. It is to be understood that outer surface contour 86 of the second shape 51 may have variation from a perfect elliptic cylinder 58. For example, there may be flat spots at the punch contact point 61 and a die contact point 62.

Figure 6A:
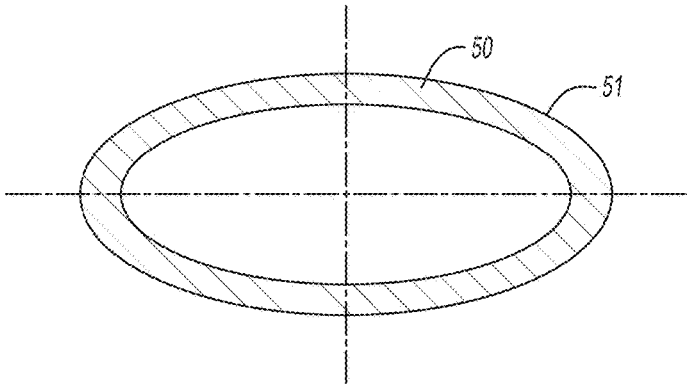
FIGS. 6A and 6B together depict dividing the hollow tubular magnetic body depicted in FIG. 5B into a plurality of curved magnets according to the present disclosure.
Figure 6B:
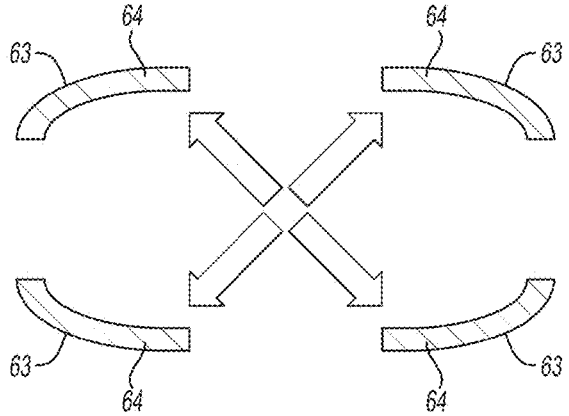

FIG. 6A and FIG. 6B depict dividing the reshaped anisotropic neodymium iron boron permanent magnet 50 into a plurality of final anisotropic neodymium iron boron permanent magnets 63. After cooling the reshaped anisotropic neodymium iron boron permanent magnet 50 having the second shape 51, curved segments 64 are cut from the reshaped anisotropic neodymium iron boron permanent magnet 50 having the second shape 51 to supply the desired curved segments 64.

Figure 7A:
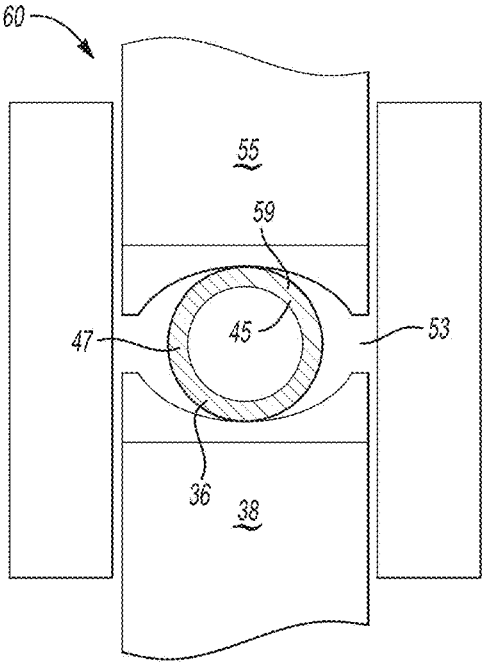
FIG. 7A is a semi-schematic cross-sectional side view of an example of a press with a die cavity defined by a punch and a die for hot deformation of a circular ring magnet according to the present disclosure.
Figure 7B:
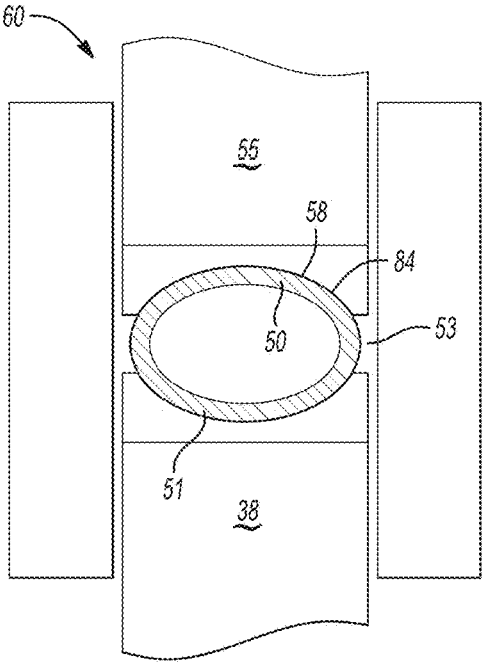
FIG. 7B is a semi-schematic cross-sectional side view of the example of the press depicted in FIG. 7A shown after the circular ring magnet has been hot deformed to a hollow tubular magnetic body with a wall surface defining an ellipse in cross-section according to the present disclosure.

FIG. 7A is a semi-schematic cross-sectional side view of a press 60 with a die cavity 53 defined by a punch 55 and a die 38 for hot deformation of a circular ring magnet 59. FIG. 7B is a semi-schematic cross-sectional side view of the press 60 depicted in FIG. 7A shown after the circular ring magnet 59 has been hot deformed to a reshaped anisotropic neodymium iron boron permanent magnet 50 having the second shape 51 conforming to the die cavity 53 defined by the punch 55 and the die 38. FIGS. 7A and 7B differ from FIG. 5A and FIG. 5B in the shape of the punch 55 and die 38. In FIGS. 5A and 5B, the punch 55 and die 38 both present flat surfaces to the original anisotropic neodymium iron boron permanent magnet 45 and to the reshaped anisotropic neodymium iron boron permanent magnet 50. However, in FIGS. 7A and 7B, the punch 55 and die 38 define a die cavity 53 that defines at least an outer surface 84 of the second shape 51. In the example depicted in FIGS. 7A and 7B, the original shape 47 is an annular cylinder 36, and the reshaped anisotropic neodymium iron boron permanent magnet 50 has an outer surface 84 that defines an elliptic cylinder 58. By changing the shape of the die cavity 53, the outer surface contour of the second shape 51 may define a pair of opposed parabolic cylinders (not shown).

Figure 8A:
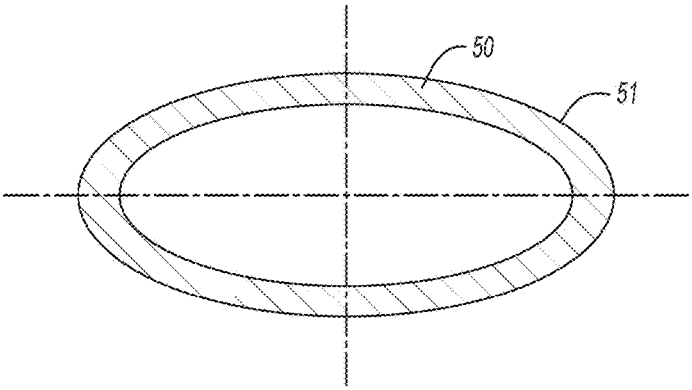
FIGS. 8A and 8B are semi-schematic cross-section views that together depict dividing the hollow tubular magnetic body depicted in FIG. 7B into a plurality of curved magnets according to the present disclosure.
Figure 8B:
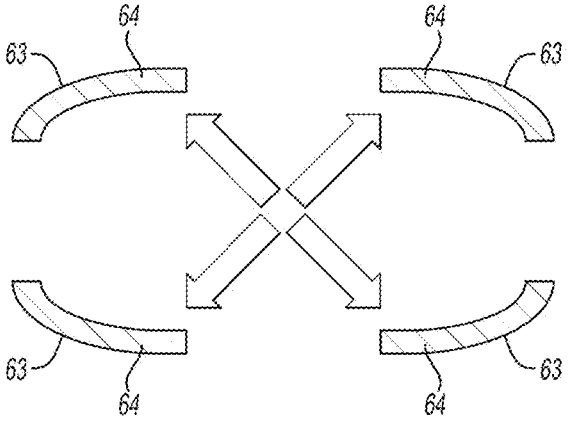

FIG. 8A and FIG. 8B depict dividing the reshaped anisotropic neodymium iron boron permanent magnet 50 into a plurality of final anisotropic neodymium iron boron permanent magnets 63. After cooling the reshaped anisotropic neodymium iron boron permanent magnet 50 having the second shape 51, curved segments 64 are cut from the reshaped anisotropic neodymium iron boron permanent magnet 50 having the second shape 51 to supply the desired curved segments 64.

Figure 9A:
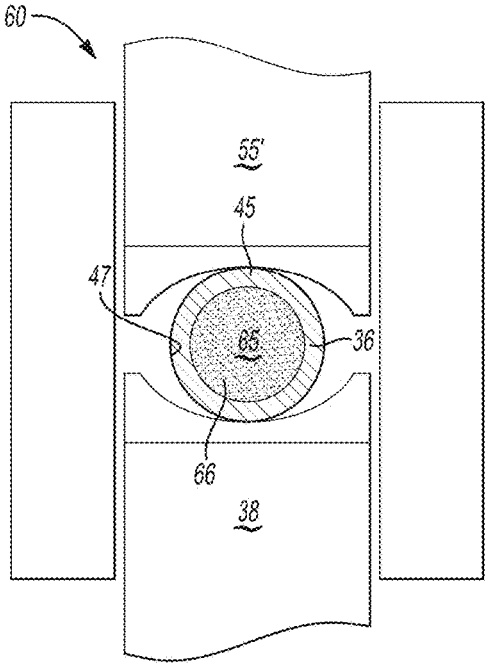
FIG. 9A is a semi-schematic cross-sectional side view of an example of a press with a die cavity defined by a punch and a die with a deformable core material inserted into a core of the annular cylinder for hot deformation of a circular ring magnet according to the present disclosure.
Figure 9B:
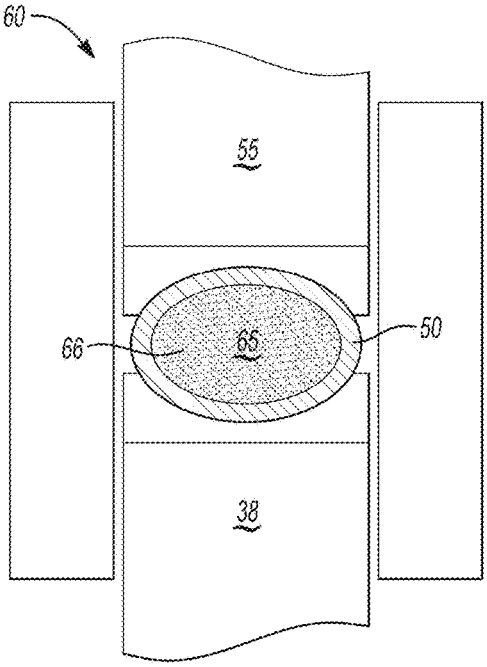
FIG. 9B is a semi-schematic cross-sectional side view of the example of the press depicted in FIG. 9A shown after the circular ring magnet has been hot deformed to a hollow tubular magnetic body with a wall surface defining an ellipse in cross-section according to the present disclosure.

FIGS. 9A and 9B are similar to FIGS. 7A and 7B except the annular cylinder 36 and the reshaped anisotropic neodymium iron boron permanent magnet 50 have a deformable core material 65 inserted into a core 66 of the annular cylinder 36 prior to the deforming to support the original anisotropic neodymium iron boron permanent magnet 45 during the deforming into the reshaped anisotropic neodymium iron boron permanent magnet 50. In the example depicted in FIG. 9A and FIG. 9B the core 66 of the annular cylinder 36 to be deformed is filled prior to the deformation with a deformable core material 65 in order to provide interior support for the original anisotropic neodymium iron boron permanent magnet 45 and the reshaped anisotropic neodymium iron boron permanent magnet 50 during deformation. The deformable core material 65 may be any material that is deformable at the deformation temperature, will not be degraded or otherwise decomposed by exposure to such temperature, and will not react with the magnet material at the deformation temperature within the time frame that the annular cylinder 36 remains at the deformation temperature. The deformable core material 65 may entirely fill the core 66 of the annular cylinder 36 as shown in FIG. 9A, or may itself be a hollow cylinder (not shown). The deformable core material 65 may include a tube formed from a soft metal that does not melt below the deformation temperature. Examples of the soft metal for the deformable core material 65 may include copper, a copper alloy, aluminum, an aluminum alloy, zinc, or a zinc alloy. The deformable core material 65 may be another semi-soft metal material. Silica sand may be another suitable deformable core material 65.

Figure 10A:
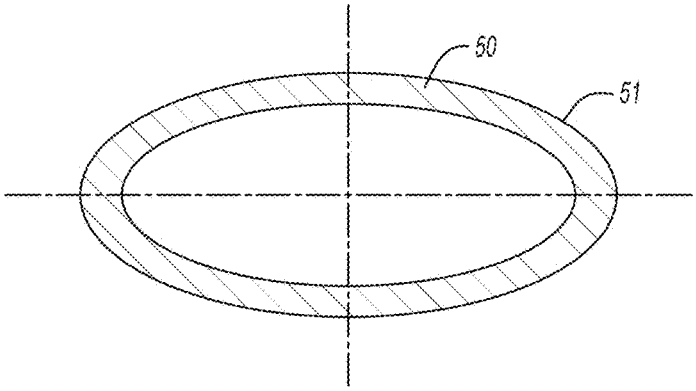
FIGS. 10A and 10B are semi-schematic cross-section views that together depict dividing the hollow tubular magnetic body depicted in FIG. 9B into a plurality of curved magnets according to the present disclosure.
Figure 10B:
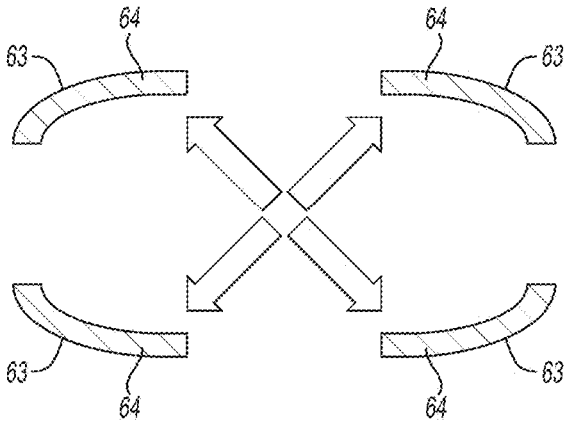

FIG. 10A and FIG. 10B depict dividing the reshaped anisotropic neodymium iron boron permanent magnet 50 into a plurality of final anisotropic neodymium iron boron permanent magnets 63. After cooling the reshaped anisotropic neodymium iron boron permanent magnet 50 having the second shape 51, curved segments 64 are cut from the reshaped anisotropic neodymium iron boron permanent magnet 50 having the second shape 51 to supply the desired curved segments 64.

Figure 11:
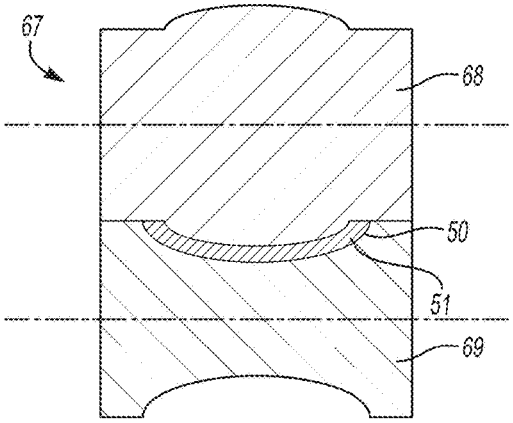
FIG. 11 is a semi-schematic cross sectional view of an example of a pair of curved rollers with a curved magnet between the rollers according to the present disclosure.

In an example of the present disclosure, the original anisotropic neodymium iron boron permanent magnet 45 may be deformed between curved heated rollers 67. As depicted in FIG. 11, a convex roller 68 and concave roller 69 fit together to form the reshaped anisotropic neodymium iron boron permanent magnet 50 into the second shape 51. As disclosed herein, the hot rolling may be performed immediately after the hot extrusion of the original anisotropic neodymium iron boron permanent magnet 45 in the same equipment chamber.

In other examples of the present disclosure (not shown), hot deformation may be accomplished by hot forging, hot swaging, or similar mechanical deformation. The deformation step is performed at a temperature high enough to allow the NdFeB material be able to flow under pressure. The material from which the original anisotropic neodymium iron boron permanent magnet is made flows under a deformation stress applied to the original anisotropic neodymium iron boron permanent magnet at the deformation temperature. For most NdFeB compositions, the deformation temperature is above 450° C., and may be above 600° C. In examples of the present disclosure, the original anisotropic neodymium iron boron permanent magnet, and the heated tooling (e.g. for example, punch 55, die 38 and heated rollers 67) may be preheated so that the time required to perform the deformation under pressure can be minimized.

Figure 12A:
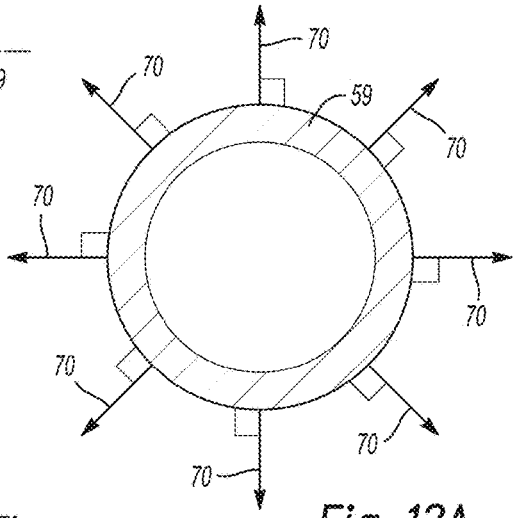
FIG. 12A is a semi-schematic cross-sectional side view of an example of a back-extruded ring magnet depicting magnetic moments aligned with a surface normal according to the present disclosure.
Figure 12B:
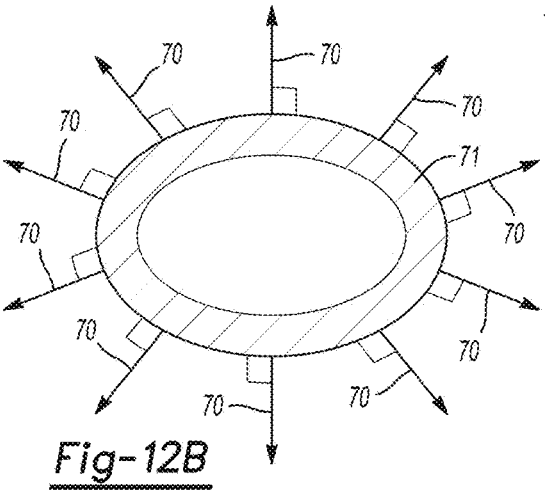
FIG. 12B is a semi-schematic cross-sectional side view of an example of a hollow tubular magnetic body with a wall surface defining an ellipse cross-section made from the example of the back-extruded ring magnet depicted in FIG. 12A by a method of the present disclosure, the magnetic moments are substantially aligned with a surface normal according to the present disclosure.
Figure 13A:
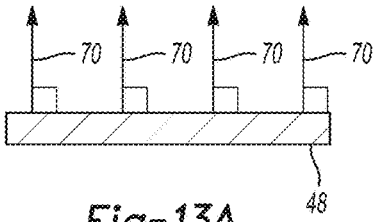
FIG. 13A is a semi-schematic cross-sectional side view of an example of an extruded plate magnet depicting magnetic moments aligned with a surface normal according to the present disclosure.
Figure 13B:
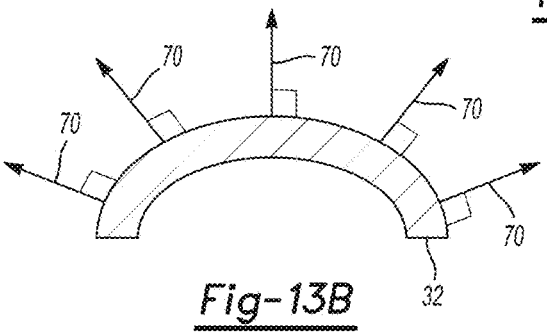
FIG. 13B is a semi-schematic cross-sectional side view of an example of a curved magnet made from the example of the extruded plate magnet depicted in FIG. 13A by a method of the present disclosure, the magnetic moments are substantially aligned with a surface normal according to the present disclosure.

Extruded flat plate NdFeB magnets have the magnetic moments oriented perpendicular to the flat plate magnet 48, and back-extruded ring magnets 59 are radially oriented. FIG. 12A is a semi-schematic cross-sectional side view of a back-extruded ring magnet 59 depicting magnetic moments 70 substantially aligned with a surface normal. As used herein, "magnetic moments substantially aligned with a surface normal" means the magnetic moments are aligned along or near the closest surface normal such that the magnetization along the surface normal is at least 85% of its saturation value. In Example 1 described in detail below, the magnetization along the surface normal of the rectangular solid 72 is about 93%, and the magnetization along the surface normal of the deformed hot pressed disc 74 is about 88%. Although the magnetic moments 70 depicted in FIGS. 12A-13B have North polarity as indicated conventionally by the arrowheads, it is to be understood that the opposite polarity is also disclosed herein. FIG. 12B is a semi-schematic cross-sectional side view of an elliptic cylinder magnet 71 made from the back-extruded ring magnet 59 depicted in FIG. 12A by a method of the present disclosure. The magnetic moments 70 are substantially aligned with a surface normal in FIG. 12B. FIG. 13A is a semi-schematic cross-sectional side view of an extruded flat plate magnet 48 depicting magnetic moments 70 substantially aligned with a surface normal. FIG. 13B is a semi-schematic cross-sectional side view of a curved permanent magnet 32 made from the extruded flat plate magnet 48 depicted in FIG. 13A by a method of the present disclosure. The magnetic moments 70 are substantially aligned with a surface normal in FIG. 13B.

After deformation, the magnetic moments 70 will remain oriented substantially in the direction of the local surface normal. Because the flat plate magnet 48 or back-extruded ring magnet 59 has already experienced hot deformation during original fabrication, the magnetic properties are retained after the additional thermal processing.

To further illustrate the present disclosure, examples are given herein. It is to be understood that these examples are provided for illustrative purposes and are not to be construed as limiting the scope of the present disclosure.

Example 1

Figure 14A:
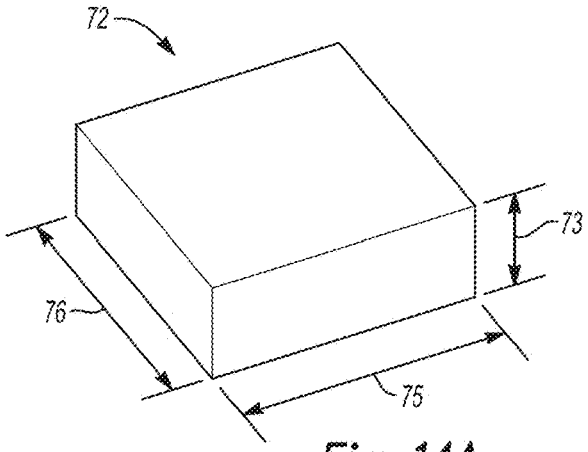
FIG. 14A depicts a 7 mm×7 mm×4 mm sample cut from a 4 mm thick extruded NdFeB plate.
Figure 14B:
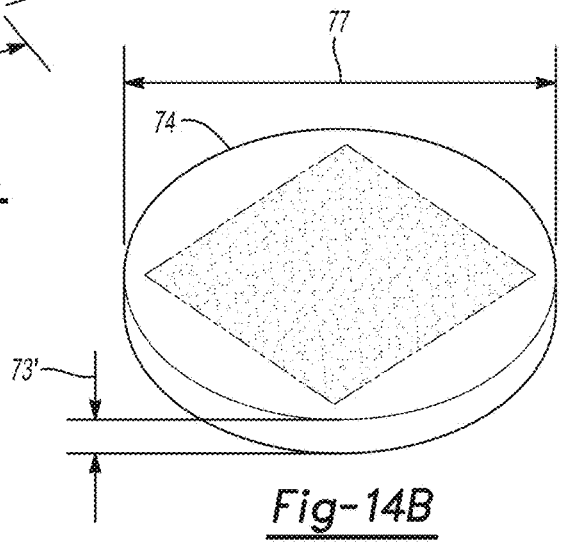
FIG. 14B depicts the sample from FIG. 14A after the sample was hot pressed at 800° C. to form a 1.6 mm thick ½ inch diameter magnet according to the present disclosure.

A rectangular solid 72 having a length 75 of 7 mm, a width 76 of 7 mm and a height 73 of 4 mm was cut from a 4 mm thick extruded NdFeB plate. The rectangular solid 72 was placed in a ½" diameter graphite hot press die with the 4 mm dimension (height 73) oriented vertically in the die. The press from this example is similar to the press 60 in FIG. 5A with a rectangular workpiece in place of the annular cylinder 36 depicted in FIG. 5A. The aligned direction of magnetization was vertical, i.e., parallel to the direction of motion of the press. The rectangular solid 72 was hot pressed at 800° C. During the hot press the rectangular solid 72 was completely deformed to fill the ½" diameter die, while reducing the original height 73 from 4 mm to a reshaped height of 1.6 mm. The diameter is shown at reference numeral 77 in FIG. 14B. Approximate volume calculations show that the deformation was volume conserving, with the initial rectangular solid and the final deformed disc both having a volume of about 200 $mm^3$ (cubic millimeters). FIG. 14A shows a sketch of an undeformed rectangular solid 72 piece and FIG. 14B shows the deformed hot pressed disc 74.

Figure 15:
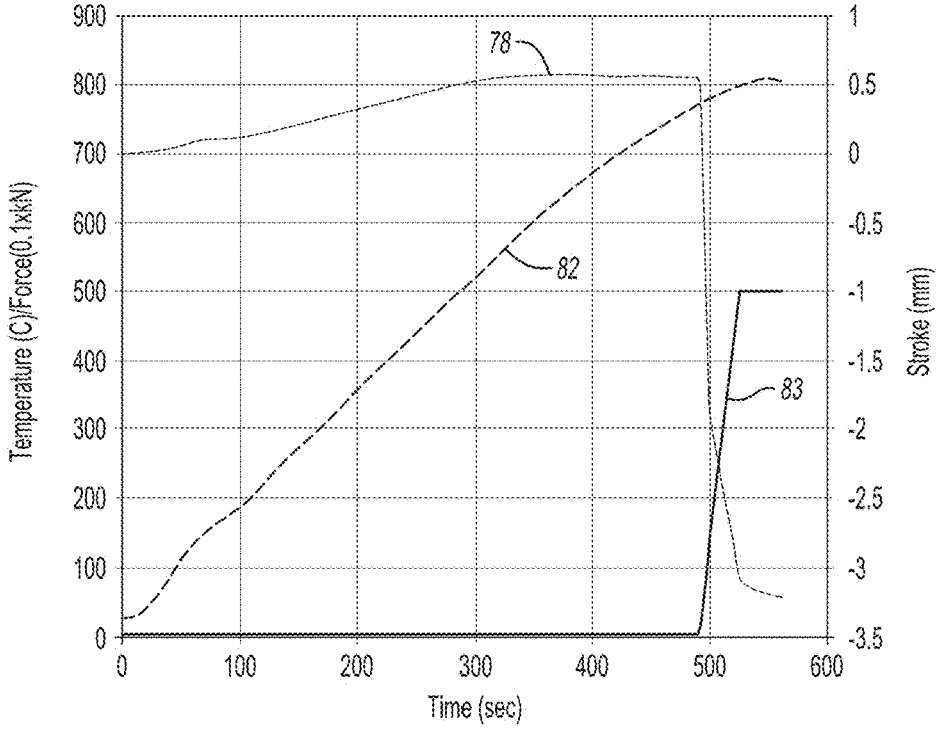
FIG. 15 is a graph depicting the temperature, applied pressure, and ram position ("stroke") as functions of time during the hot press operation that created the sample depicted in FIG. 14B.
Figure 16:
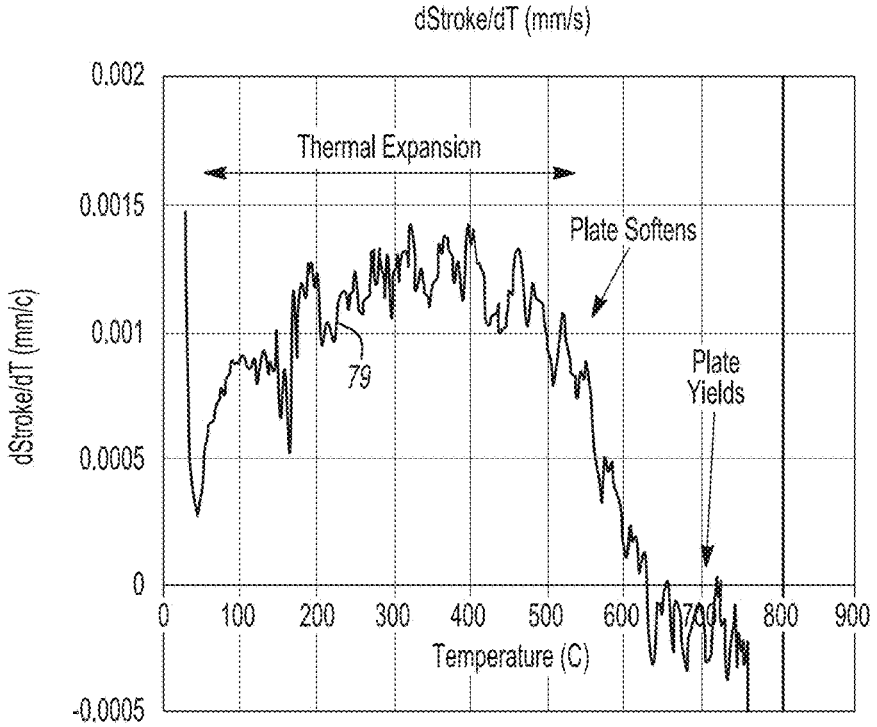
FIG. 16 is a graph depicting the temperature derivative of the stroke from the process depicted in FIG. 15.

FIG. 15 shows the temperature 82, applied pressure 83, and ram position 78 ("stroke") as functions of time during the hot press. The sample was pre-loaded with a ram force of about 0.3 kN (kiloNewtons). The die was heated at 100° C./min to 700° C., and then 50° C./min to 800° C. At 770° C. the force was increased to its maximum of 50 kN, and deformation was rapid on application of pressure. The hot press was manually terminated when deformation was complete. Initially the ram displacement is proportional to temperature, as shown by the stroke curve 78 in FIG. 15. This displacement arises from the thermal expansion of the rams and the sample during heating; expansion of the sample pushes back on the rams. At temperatures above about 450° C., however, the stroke curve 78 flattens. To display this more clearly, the temperature derivative 79 of the stroke is shown in FIG. 16. At low temperature the thermal expansion is 0.8-1.3 microns/° C.; above 450° C., however, the slope falls and goes slightly negative above about 600° C. This shows that the extruded plate 72 has softened, and represents a temperature regime in which deformation can occur.

Figure 17:
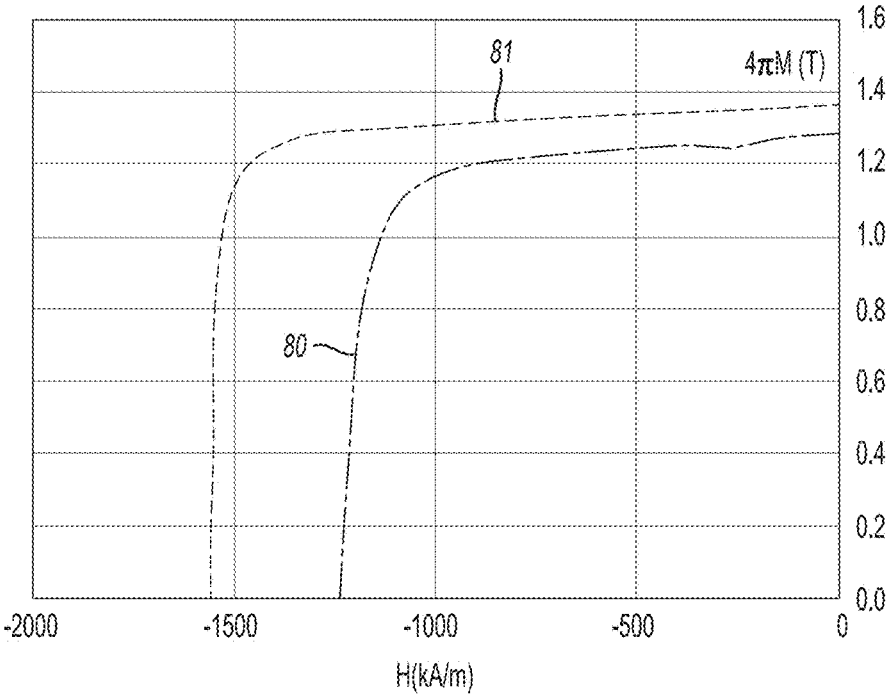
FIG. 17 is a graph depicting hysteresis curves from an extruded magnet before and after the secondary deformation depicted in FIG. 14B.

Magnetic properties of the rectangular solid 72 and the hot pressed disc 74 were evaluated by vibrating sample magnetometry (VSM). After grinding off the surface material, a cube approximately 1.4 mm on a side was cut from the center of the hot pressed disc 74. For comparison, a 4 mm×4 mm×1 mm sample was cut from the extruded plate and also measured by VSM. FIG. 17 compares the demagnetization curves of these two samples, and Table 1, which includes the intrinsic coercivity $H_{ci}$ in kiloamperes per meter (kA/m), the remanence $B_r$ in Tesla (T), and the energy product $(BH)_{max}$ in megagauss-oersteds (MGOe), summarizes the hard magnetic parameters. In FIG. 17, the curve related to the hot pressed disc 74 is at reference numeral 80 and the curve related to the 4 mm×4 mm×1 mm sample cut from the extruded plate is shown at reference numeral 81.

TABLE 1

| | Remanence $B_r$ (T) | Coercivity $H_{ci}$ (kA/m) | Energy product $(BH)_{max}$ (MGOe) |
|---|---|---|---|
| Extruded plate | 1.37 | 1610 | 44.8 |
| Hot pressed disc | 1.29 | 1240 | 38.8 |

These results demonstrate that the resulting deformed sample retained hard magnetic properties and, based on the squareness of the loop and transverse magnetic measurements, also retained large preferred orientation along the axis of the disc (the same direction as the initial plate). Some loss in coercivity was observed. The loss in coercivity is attributable to the very high deformation temperature (800° C.) and the large degree of deformation (ΔHeight/Height=60%). In contrast, a representative sintered NdFeB magnet die upset at 800° C. shattered in the press and its hard magnetic properties were almost entirely destroyed. Achieving the shapes desired for motor magnet applications, like those in FIG. 2, involves a much lower degree of deformation and a lower deformation temperature than the deformation that produced the hot pressed disc 74 from the rectangular solid 72. Without being held to any theory, it is believed that less deformation and lower temperature may contribute to preservation of coercivity.

Example 2

A rectangular solid having a length of 10 mm, a width of 6 mm, and a height of 4 mm was cut from a 4 mm thick extruded NdFeB plate. The rectangular solid was placed in a ½" diameter graphite hot press die between two graphite rams having curved surfaces similar to those shown in FIG.

4A, with the 4 mm dimension (height) oriented vertically in the die. The radius of curvature of the ram faces was designed to be 38 mm. The sample was placed across the concave surface of the lower ram face, as in FIG. 4A. The aligned direction of magnetization of the rectangular solid was vertical, i.e., parallel to the direction of motion of the press. The rectangular solid was hot pressed at 650° C. using a press force of 5 kN. During the hot press the rectangular solid was deformed into a curved arc that conformed to the surfaces of the concave lower ram and convex upper ram.

Cubes approximately 2 mm×2 mm×2 mm were cut from the arc shaped magnet at the center of the arc and at both ends of the arc. The cubes were cut with one cube axis normal to the curvature of the arc, that is, along the normal to the curved surface. The magnetic properties of the cubes were evaluated by vibrating sample magnetometry (VSM). A summary of the magnetic properties is given in Table 2, which includes the intrinsic coercivity $H_{ci}$, the remanence $B_r$, and the energy product $(BH)_{max}$. For comparison, the top row gives the magnetic properties of the extruded plate prior to being deformed into the curved arc.

TABLE 2

| | Coercivity $H_{ci}$ (kA/m) | Remanence $B_r$ (T) | Energy product $(BH)_{max}$ (MGOe) |
|---|---|---|---|
| Extruded plate | 1560 | 1.37 | 44.7 |
| Center of arc | 1600 | 1.32 | 42.0 |
| End A of arc | 1560 | 1.34 | 43.3 |
| End B of arc | 1660 | 1.33 | 42.4 |

These results demonstrate that the flat extruded plate was deformed into the desired curved magnet while maintaining the excellent magnetic properties of the original extruded plate. The coercivity was completely maintained, or even slightly increased, by the deformation to form the curved arc. The remanence was retained to within 2-4% of the starting value, showing that the curved arc almost entirely maintained the anisotropy of the starting plate, and that the magnetization remained perpendicular to the surface of the arc. The energy product of the cubes cut from the arc was within 3-6% of the starting value in the original extruded plate.

FIG. 18 depicts an example of a parabolic cylinder 57. The bases 87 of the parabolic cylinder 57 are congruent and parallel parabolas.

Figure 19:
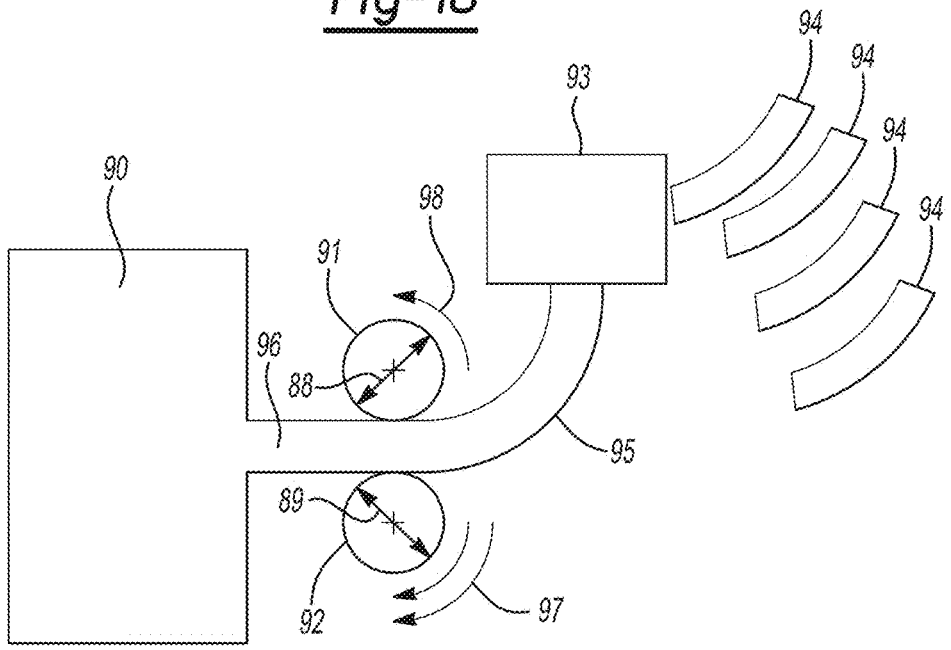
FIG. 19 is a semi-schematic cross-sectional side view of an example of an apparatus for making curved permanent magnets according to the present disclosure.

FIG. 19 is a semi-schematic cross-sectional side view of an example of an apparatus for making curved permanent magnets according to the present disclosure. FIG. 19 depicts an extruder 90 outputting a continuous stream 96 of the original anisotropic neodymium iron boron permanent magnet with an original shape being a rectangular prismatic shape. A first cylindrical roller 91 and second cylindrical roller 92 reshape the continuous stream 96 to form a reshaped anisotropic neodymium iron boron permanent magnet 95 having a curved, non-planar shape (e.g., a portion of a curved wall). The first cylindrical roller 91 rotates such that a first tangential speed 98 of the first cylindrical roller 91 at the first cylindrical roller diameter 88 is different from a second tangential speed 97 of the second cylindrical roller 92 at the second cylindrical roller diameter 89 to transform the original anisotropic neodymium iron boron permanent magnet 96 having the original shape into the reshaped anisotropic neodymium iron boron permanent magnet 95 having a second shape being the rectangular prismatic shape. The first cylindrical roller diameter 98 may be the same as or different from the second cylindrical roller diameter 99. As used herein, tangential speed means the magnitude of the tangential component of linear velocity of a cylinder relative to a center of rotation of the cylinder. As depicted in FIG. 19, the single arrow at reference numeral 98 indicates a slower speed than the speed indicated by the two adjacent arrows at reference numeral 97. Therefore, since the first cylindrical roller 91 rolls slower than the second cylindrical roller 92, the reshaped anisotropic neodymium iron boron permanent magnet 95 acquires concavity toward the first cylindrical roller 91.

The reshaped anisotropic neodymium iron boron permanent magnet 95 enters a divider 93 that cuts the continuous stream of the reshaped anisotropic neodymium iron boron permanent magnet 95 into arc-shaped magnet pieces 94. The original anisotropic neodymium iron boron permanent magnet 96 and the reshaped anisotropic neodymium iron boron permanent magnet 95 each have respective magnetic moments substantially aligned with a respective local surface normal corresponding to the respective magnetic moment. The divider 93 may be an abrasive cut-off wheel. In some examples, the divider 93 may be a score and snap divider.

Figure 20A:
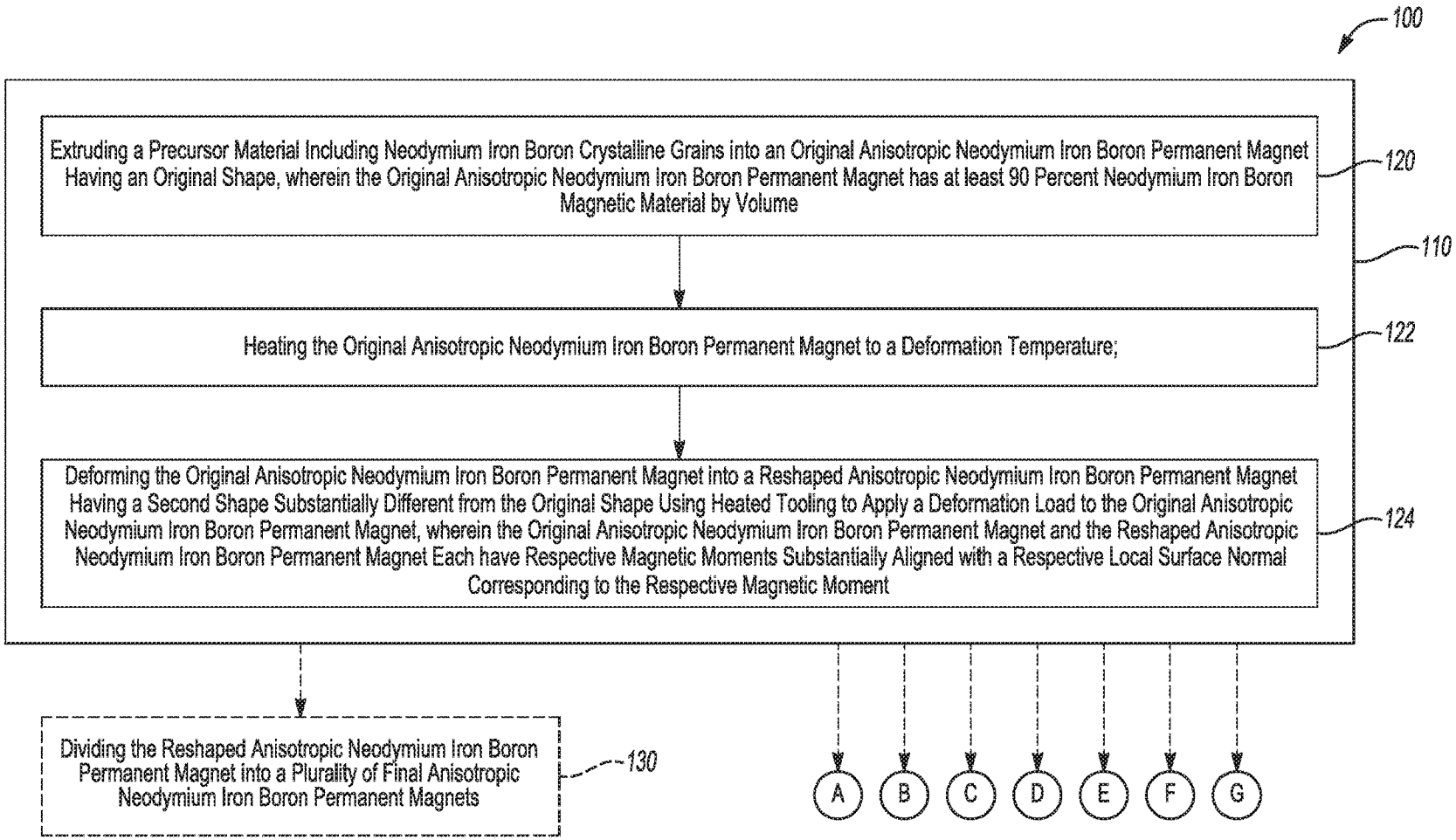
FIG. 20A-FIG. 20C together are a flow chart depicting an example of the method for fabricating a non-planar magnet according to the present disclosure.
Figure 20B:
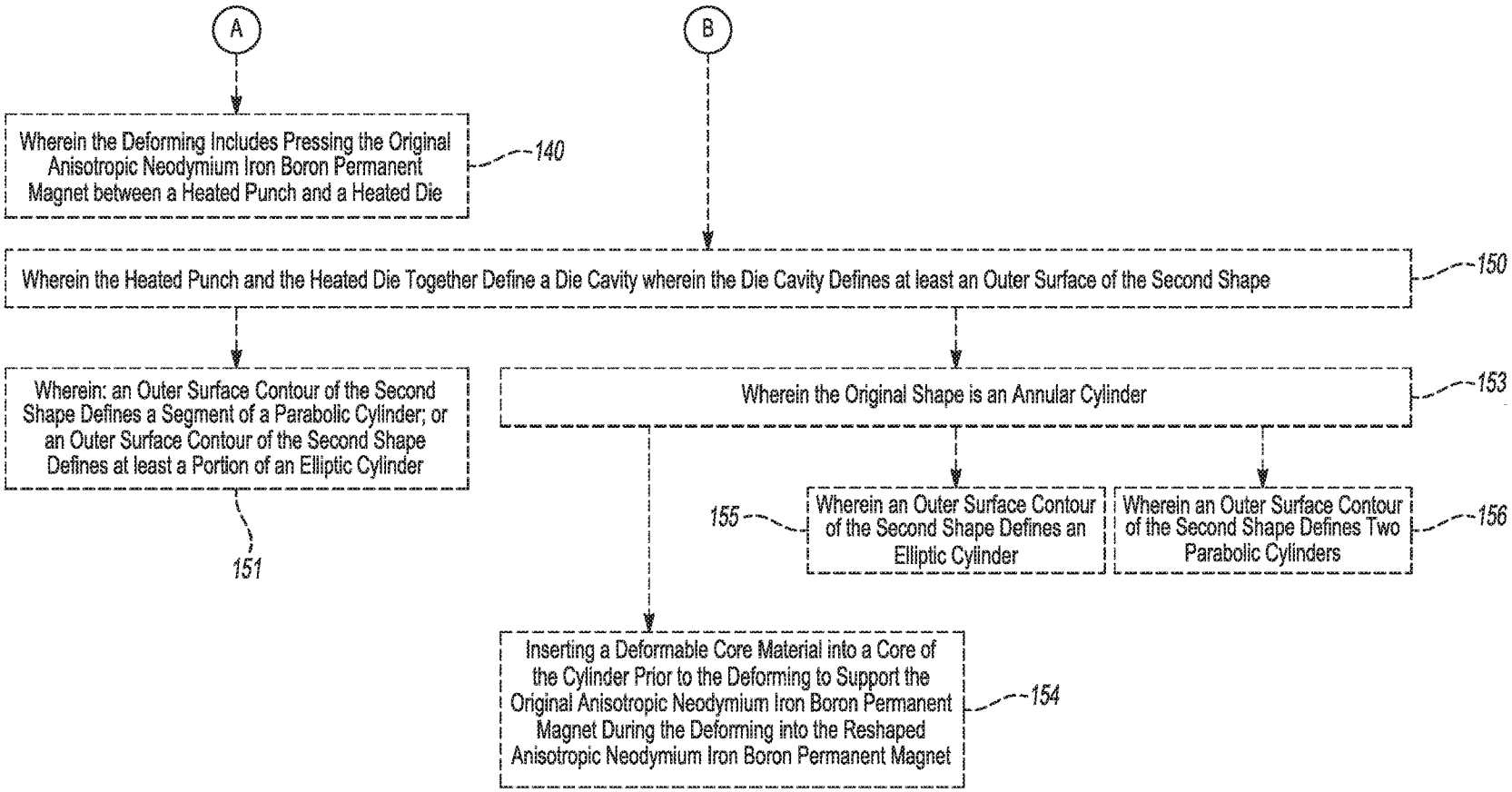
Figure 20C:
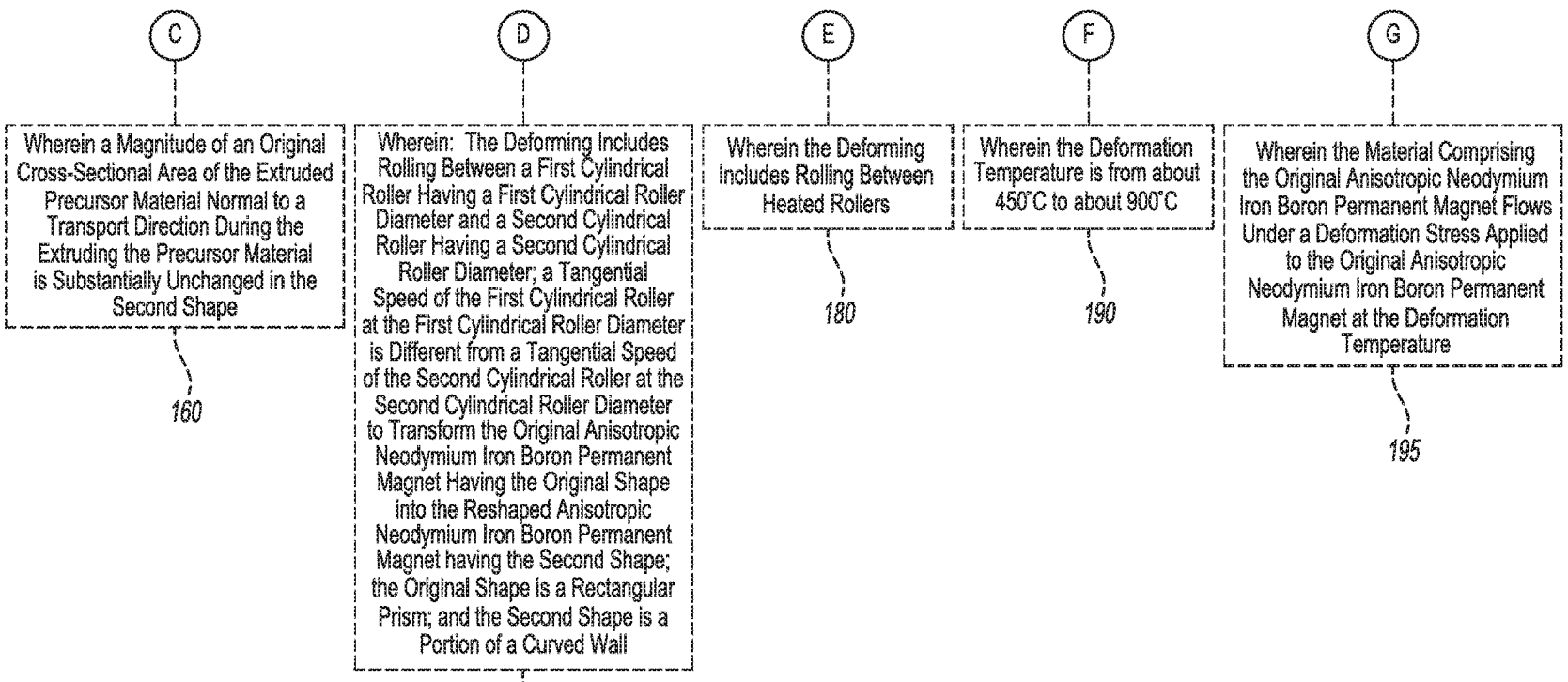

FIG. 20A-FIG. 20C together are a flow chart depicting an example of the method 100 for fabricating a non-planar magnet according to the present disclosure. FIG. 20A depicts a set of steps shown in box 110 included in the method 100. Dashed lines in the flow chart of FIG. 20A-FIG. 20C depict elements and steps that may be implemented optionally in the method 100 according to the present disclosure.

In FIG. 20A, box 120 depicts "extruding a precursor material including neodymium iron boron crystalline grains into an original anisotropic neodymium iron boron permanent magnet having an original shape, wherein the original anisotropic neodymium iron boron permanent magnet has at least 90 percent neodymium iron boron magnetic material by volume". At box 122, is "heating the original anisotropic neodymium iron boron permanent magnet to a deformation temperature". At box 124, is "deforming the original anisotropic neodymium iron boron permanent magnet into a reshaped anisotropic neodymium iron boron permanent magnet having a second shape substantially different from the original shape using heated tooling to apply a deformation load to the original anisotropic neodymium iron boron permanent magnet, wherein the original anisotropic neodymium iron boron permanent magnet and the reshaped anisotropic neodymium iron boron permanent magnet each have respective magnetic moments substantially aligned with a respective local surface normal corresponding to the respective magnetic moment". At box 130, is "dividing the reshaped anisotropic neodymium iron boron permanent magnet into a plurality of final anisotropic neodymium iron boron permanent magnets".

A flow chart connector A indicates the connection between box 110 in FIG. 20A and box 140 shown in FIG. 20B. At box 140, is "wherein the deforming includes pressing the original anisotropic neodymium iron boron permanent magnet between a heated punch and a heated die". A flow chart connector B indicates the connection between box 110 in FIG. 20A and box 150 shown in FIG. 20B. At box 150, is "wherein the heated punch and the heated die together define a die cavity wherein the die cavity defines at least an outer surface of the second shape". At box 151, is "wherein: an outer surface contour of the second shape defines a segment of a parabolic cylinder; or an outer surface contour of the second shape defines at least a portion of an elliptic cylinder". At box 153, is "wherein the original shape is an annular cylinder". At box 154, is "inserting a deformable core material into a core of the annular cylinder prior to the deforming to support the original anisotropic neodymium iron boron permanent magnet during the deforming into the reshaped anisotropic neodymium iron boron permanent magnet". At box 155, is "wherein an outer surface contour of the second shape defines an elliptic cylinder". At box 156, is "wherein an outer surface contour of the second shape defines two parabolic cylinders".

A flow chart connector C indicates the connection between box 110 in FIG. 20A and box 160 shown in FIG. 20C. At box 160, is "wherein a magnitude of an original cross-sectional area of the extruded precursor material normal to a transport direction during the extruding the precursor material is substantially unchanged in the second shape".

A flow chart connector D indicates the connection between box 110 in FIG. 20A and box 170 shown in FIG. 20C. At box 170, is "wherein: the deforming includes rolling between a first cylindrical roller having a first cylindrical roller diameter and a second cylindrical roller having a second cylindrical roller diameter; a tangential speed of the first cylindrical roller at the first cylindrical roller diameter is different from a tangential speed of the second cylindrical roller at the second cylindrical roller diameter to transform the original anisotropic neodymium iron boron permanent magnet having the original shape into the reshaped anisotropic neodymium iron boron permanent magnet having the second shape; the original shape is a rectangular prism; and the second shape is a portion of a curved wall".

A flow chart connector E indicates the connection between box 110 in FIG. 20A and box 180 shown in FIG. 20C. At box 180, is "wherein the deforming includes rolling between heated rollers".

A flow chart connector F indicates the connection between box 110 in FIG. 20A and box 190 shown in FIG. 20C. At box 190, is "wherein the deformation temperature is from about 450° C. to about 900° C.".

A flow chart connector G indicates the connection between box 110 in FIG. 20A and box 195 shown in FIG. 20C. At box 195, is "wherein the material comprising the original anisotropic neodymium iron boron permanent magnet flows under a deformation stress applied to the original anisotropic neodymium iron boron permanent magnet at the deformation temperature".

Figure 21:
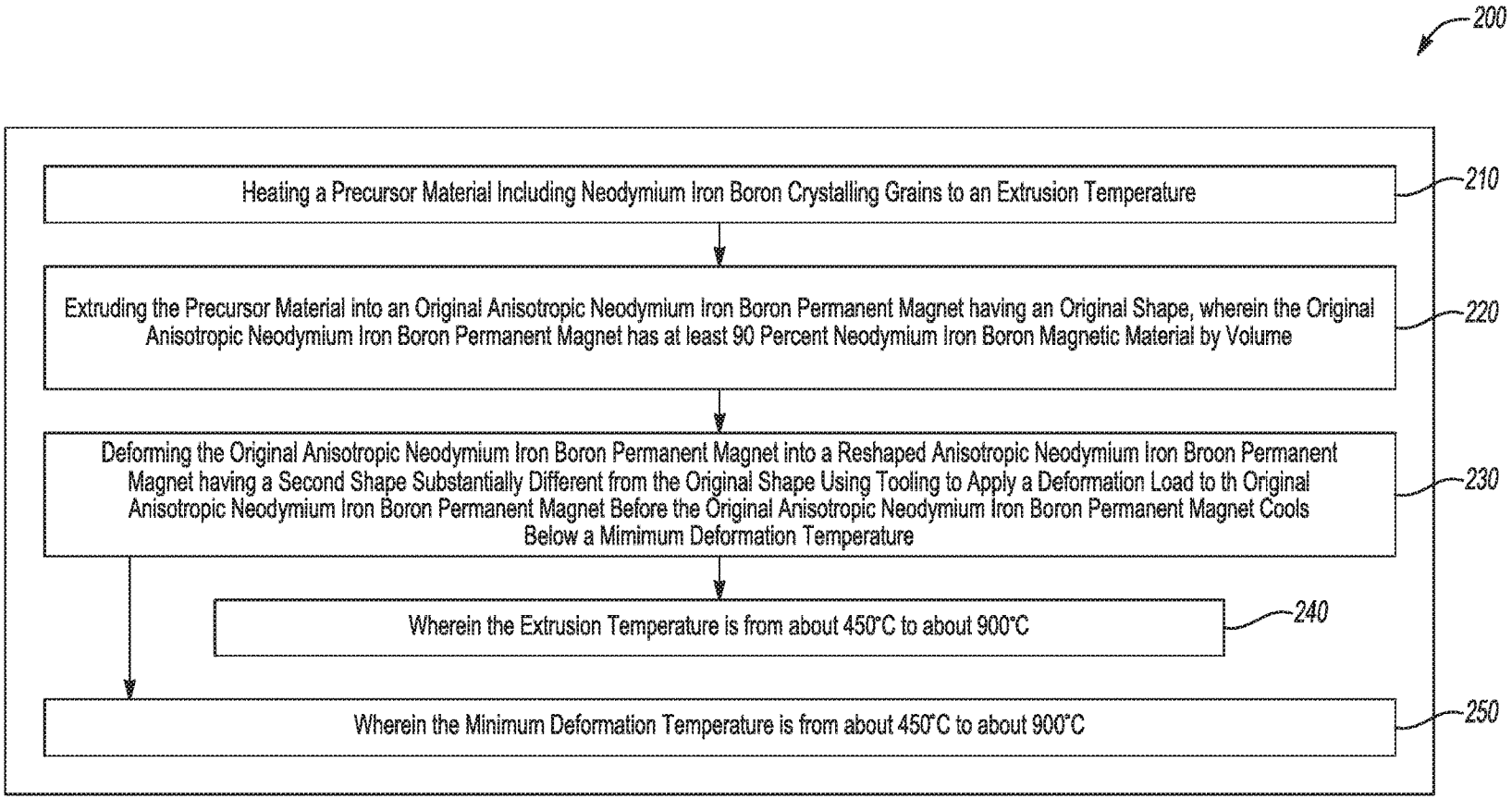
FIG. 21 is a flow chart depicting another example of the method for fabricating a non-planar magnet according to the present disclosure.

FIG. 21 is a flow chart depicting another example of the method 200 for fabricating a non-planar magnet according to the present disclosure. FIG. 21 depicts a set of steps shown in box 200 representing the method 200. At box 210, is "heating a precursor material including neodymium iron boron crystalline grains to an extrusion temperature". At box 220, is "extruding the precursor material into an original anisotropic neodymium iron boron permanent magnet having an original shape, wherein the original anisotropic neodymium iron boron permanent magnet has at least 90 percent neodymium iron boron magnetic material by volume". At box 230, is "deforming the original anisotropic neodymium iron boron permanent magnet into a reshaped anisotropic neodymium iron boron permanent magnet having a second shape substantially different from the original shape using tooling to apply a deformation load to the original anisotropic neodymium iron boron permanent magnet before the original anisotropic neodymium iron boron permanent magnet cools below a minimum deformation temperature". At box 240, is "wherein the extrusion temperature is from about 450° C. to about 900° C.". At box 250, is wherein the minimum deformation temperature is from about 450° C. to about 900° C.".

Reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

It is to be understood that the ranges provided herein include the stated range and any value or sub-range within the stated range. For example, a range from about 600° C. to about 900° C. should be interpreted to include not only the explicitly recited limits of from about 600° C. to about 900° C., but also to include individual values, such as 650° C., 790° C., 805° C., etc., and sub-ranges, such as from about 675° C. to about 800° C., etc. Furthermore, when "about" is utilized to describe a value, this is meant to encompass minor variations (up to +/−10 percent) from the stated value.

Further, the terms "connect/connected/connection" and/or the like are broadly defined herein to encompass a variety of divergent connected arrangements and assembly techniques. These arrangements and techniques include, but are not limited to (1) the direct communication between one component and another component with no intervening components therebetween; and (2) the communication of one component and another component with one or more components therebetween, provided that the one component being "connected to" the other component is somehow in operative communication with the other component (notwithstanding the presence of one or more additional components therebetween).

In describing and claiming the examples disclosed herein, the singular forms "a", "an", and "the" include plural referents unless the context clearly dictates otherwise.

While several examples have been described in detail, it is to be understood that the disclosed examples may be modified. Therefore, the foregoing description is to be considered non-limiting.

The invention claimed is:

1. A method for fabricating a non-planar magnet, comprising:

extruding a precursor material including neodymium iron boron crystalline grains into an original anisotropic neodymium iron boron permanent magnet having an original shape, wherein the original anisotropic neodymium iron boron permanent magnet has at least 90 percent neodymium iron boron magnetic material by volume;

heating the original anisotropic neodymium iron boron permanent magnet to a deformation temperature; and deforming the original anisotropic neodymium iron boron permanent magnet into a reshaped anisotropic neodymium iron boron permanent magnet having a second shape substantially different from the original shape using heated tooling to apply a deformation load to the original anisotropic neodymium iron boron permanent magnet, wherein the original anisotropic neodymium iron boron permanent magnet and the reshaped anisotropic neodymium iron boron permanent magnet each have respective magnetic moments substantially aligned with a respective local surface normal corresponding to the respective magnetic moment.

2. The method as defined in claim 1, further comprising dividing the reshaped anisotropic neodymium iron boron permanent magnet into a plurality of final anisotropic neodymium iron boron permanent magnets.

3. The method as defined in claim 1 wherein the deforming includes pressing the original anisotropic neodymium iron boron permanent magnet between a heated punch and a heated die.

4. The method as defined in claim 3 wherein the heated punch and the heated die together define a die cavity, wherein the die cavity defines at least an outer surface of the second shape.

5. The method as defined in claim 4 wherein:

an outer surface contour of the second shape defines a segment of a parabolic cylinder; or the outer surface contour of the second shape defines at least a portion of an elliptic cylinder.

6. The method as defined in claim 4 wherein the original shape is an annular cylinder.

7. The method as defined in claim 6, further including inserting a deformable core material into a core of the annular cylinder prior to the deforming to support the original anisotropic neodymium iron boron permanent magnet during the deforming into the reshaped anisotropic neodymium iron boron permanent magnet.

8. The method as defined in claim 6 wherein an outer surface contour of the second shape defines an elliptic cylinder.

9. The method as defined in claim 6 wherein an outer surface contour of the second shape defines two parabolic cylinders.

10. The method as defined in claim 1 wherein the deforming includes rolling between heated rollers.

11. The method as defined in claim 1 wherein a magnitude of an original cross-sectional area of the extruded precursor material normal to a transport direction during the extruding the precursor material is substantially unchanged in the second shape.

12. The method as defined in claim 1 wherein:

the deforming includes rolling between a first cylindrical roller having a first cylindrical roller diameter and a second cylindrical roller having a second cylindrical roller diameter;

a first tangential speed of the first cylindrical roller at the first cylindrical roller diameter is different from a second tangential speed of the second cylindrical roller at the second cylindrical roller diameter to transform the original anisotropic neodymium iron boron permanent magnet having the original shape into the reshaped anisotropic neodymium iron boron permanent magnet having the second shape;

the original shape is a rectangular prism; and the second shape is a portion of a curved wall.

13. The method as defined in claim 1 wherein the deformation temperature is from about 450° C. to about 900° C.

14. The method as defined in claim 1 wherein the material comprising the original anisotropic neodymium iron boron permanent magnet flows under a deformation stress applied to the original anisotropic neodymium iron boron permanent magnet at the deformation temperature.

15. A method for fabricating a non-planar magnet, comprising:

heating a precursor material including neodymium iron boron crystalline grains to an extrusion temperature;

extruding the precursor material into an original anisotropic neodymium iron boron permanent magnet having an original shape, wherein the original anisotropic neodymium iron boron permanent magnet has at least 90 percent neodymium iron boron magnetic material by volume; and deforming the original anisotropic neodymium iron boron permanent magnet into a reshaped anisotropic neodymium iron boron permanent magnet having a second shape substantially different from the original shape using tooling to apply a deformation load to the original anisotropic neodymium iron boron permanent magnet before the original anisotropic neodymium iron boron permanent magnet cools below a minimum deformation temperature;

wherein the extrusion temperature is from about 450° C. to about 900° C.;

and wherein the minimum deformation temperature is from about 450° C. to about 900° C.

* * * * *